US008268408B2

(12) United States Patent
Miyoshi

(10) Patent No.: US 8,268,408 B2
(45) Date of Patent: Sep. 18, 2012

(54) METHOD OF MANUFACTURING COMPOSITE STRUCTURE, IMPURITY REMOVAL PROCESSING APPARATUS, FILM FORMING APPARATUS, COMPOSITE STRUCTURE AND RAW MATERIAL POWDER

(75) Inventor: Tetsu Miyoshi, Kaisei-machi (JP)

(73) Assignee: FUJIFILM Corporation, Tokyo (JP)

( * ) Notice: Subject to any disclaimer, the term of this patent is extended or adjusted under 35 U.S.C. 154(b) by 716 days.

(21) Appl. No.: 11/919,804

(22) PCT Filed: Sep. 27, 2006

(86) PCT No.: PCT/JP2006/319814

§ 371 (c)(1),
(2), (4) Date: Nov. 2, 2007

(87) PCT Pub. No.: WO2007/037498

PCT Pub. Date: Apr. 5, 2007

(65) Prior Publication Data

US 2009/0142619 A1 Jun. 4, 2009

(30) Foreign Application Priority Data

Sep. 30, 2005 (JP) ..... 2005-289261

(51) Int. Cl.
*B05D 3/00* (2006.01)
*B05D 5/12* (2006.01)

(52) U.S. Cl. ..... 427/561; 427/569; 427/100; 427/189; 427/190

(58) Field of Classification Search ..... None
See application file for complete search history.

(56) References Cited

U.S. PATENT DOCUMENTS 6,106,890 A 8/2000 Hayashi
(Continued)

FOREIGN PATENT DOCUMENTS

CN 1481450 A 3/2004
(Continued)

OTHER PUBLICATIONS

Notification of the First Office Action, dated May 22, 2009, issued in corresponding CN Application No. 2006800149679, 14 pages English and Chinese.

(Continued)

*Primary Examiner* — David Turocy
*Assistant Examiner* — Joel Horning
(74) *Attorney, Agent, or Firm* — Sughrue Mion, PLLC

(57) ABSTRACT

A film forming apparatus for forming a film according to an AD method in which separation of the film or generation of hillocks is suppressed when the film formed on a substrate is heat-treated. The apparatus includes: an aerosol generating unit (1-4) for dispersing raw material powder (20) with a gas, thereby aerosolizing the raw material powder (20); a processing unit (6) for processing the raw material powder (20) aerosolized by the aerosol generating unit (1-4) to reduce an amount of impurity, which generates a gas by being heated, adhering to or contained in the raw material powder (20); and an injection nozzle (9) for spraying the aerosolized raw material powder (20) processed by the processing unit (6) toward a substrate (30) to deposit the raw material powder (20) on the substrate (30).

11 Claims, 18 Drawing Sheets

U.S. PATENT DOCUMENTS

| | | | |
|---|---|---|---|
| 2004/0026030 | A1 | 2/2004 | Hatono et al. |
| 2004/0043230 | A1 | 3/2004 | Hatono et al. |
| 2006/0068105 | A1 | 3/2006 | Osawa |
| 2006/0124057 | A1 | 6/2006 | Sasaki |

FOREIGN PATENT DOCUMENTS

| | | | | |
|---|---|---|---|---|
| EP | 1 510 598 | A1 | | 5/2005 |
| JP | 10-324519 | A | | 12/1998 |
| JP | 2002-235181 | A | | 8/2002 |
| JP | 2003-213451 | A | | 7/2003 |
| JP | 2003-275630 | A | | 9/2003 |
| JP | 2005-36255 | A | | 2/2005 |
| JP | 2005036255 | | * | 2/2005 |
| JP | 2005-120440 | A | | 5/2005 |
| JP | 2006-97087 | A | | 4/2006 |

OTHER PUBLICATIONS

Shoko Kikuchi, et al., "Photostrictive Characteristics of Fine-Grained PLZT Ceramics Derived from Mechanically Alloyed Powder", Journal of the Ceramic Society of Japan, 2004, pp. 572-576, vol. 112, No. 10.

Tetsu Miyoshi, Evaluation of Pb(Zr, Ti)$O_3$ Ceramics Prepared by Aerosol Deposition, 2007 The Japan Society of Applied Physics, vol. 46, No. 10B, 2007, pp. 7018-7023.

Tetsu Miyoshi et al, Effects of Substrate Clamping on Electrical Properties of Polycrystalline Piezoelectric Films, Japanese Journal of Applied Physics 48 (2009), pp. 09KD09-1-09KD09-6.

Japanese Office Action corresponding to Japanese Patent Application No. 2006-258902 mailed Aug. 30, 2011.

* cited by examiner

BEFORE HEAT TREATMENT

AFTER HEAT TREATMENT

GC-MS/TOTAL ION CHROMATOGRAM (SAMPLE A)

BEFORE HEAT TREATMENT

AFTER HEAT TREATMENT

FIG.10

CARBON IMPURITY CONTAINED IN AD FILM, ANNEAL CONDITIONS, AND FILM STATUSES AFTER ANNEAL

| ANNEAL CONDITION / AD FILM | (1) 600°C × 3h | (2) 700°C × 3h | (3) 800°C × 3h | (4) 900°C × 3h | (5) 1000°C × 3h |
|---|---|---|---|---|---|
| (a) 222ppm | SEPARATION AND HILLOCKS ARE GENERATED | SEPARATION AND HILLOCKS ARE GENERATED | SEPARATION AND HILLOCKS ARE GENERATED | SEPARATION AND HILLOCKS ARE GENERATED | SEPARATION AND HILLOCKS ARE GENERATED |
| (b) 150ppm | ○ | ○ | ONLY HILLOCKS ARE GENERATED | ONLY HILLOCKS ARE GENERATED | ONLY HILLOCKS ARE GENERATED |
| (c) 136ppm | ○ | ○ | ○ | ONLY HILLOCKS ARE GENERATED | ONLY HILLOCKS ARE GENERATED |
| (d) 93ppm | ○ | ○ | ○ | ○ | ○ |
| (e) 56ppm | ○ | ○ | ○ | ○ | ○ |

METHOD OF MANUFACTURING COMPOSITE STRUCTURE, IMPURITY REMOVAL PROCESSING APPARATUS, FILM FORMING APPARATUS, COMPOSITE STRUCTURE AND RAW MATERIAL POWDER

TECHNICAL FIELD

The present invention relates to a method of manufacturing a composite structure by using an aerosol deposition method of depositing raw material powder on a substrate by injecting the raw material powder toward the substrate, and an impurity removal processing apparatus and a film forming apparatus to be used in the method of manufacturing a composite structure. Further, the present invention relates to a composite structure manufactured by using the method of manufacturing a composite structure, and raw material powder to be used in the method of manufacturing a composite structure.

BACKGROUND ART

Recent years, in the field of micro electrical mechanical system (MEMS), the manufacture of devices containing functional materials such as electronic ceramics, which express predetermined functions by being applied with voltages, like dielectric materials, piezoelectric materials, magnetic materials, pyroelectric materials, and semiconductor materials by using film formation technologies has been actively studied.

For example, in order to enable high-definition and high-quality printing in an inkjet printer, it is necessary to miniaturize and highly integrate ink nozzles of an inkjet head. Accordingly, it is also necessary to similarly miniaturize and highly integrate piezoelectric actuators for driving the respective ink nozzles. In this case, a film formation technology that enables formation of a thinner layer than a bulk material and formation of fine patterns is advantageous.

Recently, as one of the film formation technologies, the aerosol deposition method (hereinafter, referred to as "AD method") known as a technology for forming a film of ceramics, metals and so on has received attention. The AD method is a film forming method of depositing a raw material on a substrate by dispersing powder of the raw material (raw material powder) in a gas (aerosolizing) and injecting it toward the substrate from a nozzle. Here, the aerosol refers to solid or liquid microparticles floating in a gas. The AD method is also referred to as "injection deposition method" or "gas deposition method".

As a related technology, Japanese Patent Application Publication JP-P2002-235181A (page 2) discloses a method of fabricating a composite structure including, after the step of applying internal strain to brittle material microparticles, the steps of allowing the brittle material microparticles applied with the internal strain to collide with a base material surface at a high speed for deforming or crushing the brittle material microparticles by the impact of the collision, rebinding the microparticles via active newly-formed surfaces formed by the deformation or crushing and thereby forming an anchor part made of a polycrystalline brittle material, a part of which cuts into the base material surface, at the boundary part between the brittle material and the base material, and subsequently forming a structure made of a polycrystalline brittle material on the anchor part.

As disclosed in JP-P2002-235181A, according to the AD method, the substrate and the structure formed thereon are brought into strong and close contact due to the presence of the anchor part. Further, the film formation mechanism of binding the microparticles on the active newly formed surfaces formed at the time of collision is called mechanochemical reaction. Since a dense and strong film can be formed according to the AD method, it is expected that the performance of devices applied with various kinds of functional films is improved.

Further, Japanese Patent Application Publication JP-P2005-36255A (pages 1, 6, 8 and 11) discloses a method of fabricating a composite structure including the steps of performing energy application such as plasma application or microwave application on microparticles of a brittle material in a reduced-pressure atmosphere, and then, injecting an aerosol formed by dispersing the microparticles of the brittle material applied with energy in a gas from a nozzle toward a base material so that the aerosol collides with a surface of the substrate to crush and deform the microparticles and bond the microparticles to the substrate due to the impact of the collision, and thereby forming a structure made of the constituent material of the microparticles on the base material.

In JP-P2005-36255A (page 11), in order to strongly bond the microparticles colliding with the substrate or the like, the microparticle surfaces are activated by applying energy of plasma or the like to the microparticles before aerosolization to remove impurity containing physisorbed water or chemisorbed water (water molecules hydrogen-bonding to hydroxyl groups and so on in the microparticle surfaces) and organic materials adhering to the surfaces of the microparticles. Further, as a result, mixture of impurities into the formed structure can be also prevented. Furthermore, JP-P2005-36255A (pages 6 and 8) also discloses that, in order to improve the speed of structure formation, a chemisorption layer is formed by using a steam generator on the surfaces of the microparticles after the impurities are once removed.

By the way, when a piezoelectric material such as PZT (lead zirconium titanate) is fabricated by using the AD method, it is necessary to heat-treat (post-anneal) the piezoelectric material after film formation because the piezoelectric material does not exhibit a sufficient electric property as it is. The reason is that the piezoelectric material exhibits a better piezoelectric property with a larger crystal particle diameter, and the crystal grain growth is promoted by the heat treatment. The relationship between the crystal particle diameter and the piezoelectric performance is described in Kikuchi et al., "Photostrictive Characteristics of Fine-Grained PLZT Ceramics Derived from Mechanically Alloyed Powder", Journal of the Ceramic Society of Japan, Vol. 112, No. 10 (2004), pp. 572-576.

However, when a film formed by using the AD method, that is, an AD film is heat-treated at a predetermined temperature (typically, a higher temperature than the film formation temperature), sometimes the film is separated from the substrate in spite of the presence of the anchor part. Alternatively, sometimes a phenomenon called "hillock" that the film is partly expands occurs at the time of heat treatment.

Although the post-anneal is essential for improving the electric property of the piezoelectric material, when such a phenomenon occurs, it becomes impossible to use the formed film as the piezoelectric material. Accordingly, it is conventionally impossible to heat-treat the AD film at a high temperature (e.g., 1000° C.), nor make a particle diameter of the PZT larger than 500 nm, for example.

DISCLOSURE OF THE INVENTION

Accordingly, in view of the above-mentioned problems, a first purpose of the present invention is to provide a method of manufacturing a composite structure according to the AD method in which separation of a film or occurrence of hillocks is suppressed when the film formed on a substrate is heat-treated. Further, a second purpose of the present invention is to provide an impurity removal processing apparatus and a film forming apparatus to be used in the method of manufacturing a composite structure. Furthermore, a third purpose of the present invention is to provide a composite structure manufactured by using the method of manufacturing a composite structure, and raw material powder to be used in the method of manufacturing a composite structure.

In order to accomplish the purposes, a method of manufacturing a composite structure according to one aspect of the present invention includes the steps of: (a) dispersing raw material powder formed of an inorganic material with a gas, thereby aerosolizing the raw material powder; (b) heating the raw material powder to a temperature lower than a melting point thereof to generate carbon dioxide gas so as to reduce an amount of carbon or compound containing carbon as impurity adhering to or contained in the raw material powder; and (c) spraying the aerosolized raw material powder toward a substrate to cause the raw material powder to collide with an under layer, thereby binding particles having active surfaces newly-formed by deformation and/or crushing of the raw material powder at a time of collision to deposit the raw material powder and form a polycrystalline structure directly or indirectly on the substrate.

An impurity removal processing apparatus according to one aspect of the present invention includes: aerosol generating means for dispersing raw material powder with a gas, thereby aerosolizing the raw material powder; and processing means for heating the raw material powder aerosolized by the aerosol generating means to a temperature lower than a melting point thereof to generate carbon dioxide gas so as to reduce an amount of carbon or compound containing carbon as impurity adhering to or contained in the raw material powder.

A film forming apparatus according to one aspect of the present invention includes: aerosol generating means for dispersing raw material powder (20) with a gas, thereby aerosolizing the raw material powder (20); processing means for heating the raw material powder aerosolized by the aerosol generating means to a temperature lower than a melting point thereof to generate carbon dioxide gas so as to reduce an amount of carbon or compound containing carbon as impurity adhering to or contained in the raw material powder; and an injection nozzle for spraying the aerosolized raw material powder heated by the processing means toward a substrate to deposit the raw material powder on the substrate.

A composite structure according to one aspect of the present invention includes: a substrate; and a polycrystalline structure formed directly or indirectly on the substrate by spraying raw material powder formed of an inorganic material toward the substrate to cause the raw material powder to collide with an under layer, thereby binding particles having active surfaces newly-formed by deformation and/or crushing of the raw material powder at a time of collision to deposit the raw material powder according to an aerosol deposition method, wherein the polycrystalline structure contains carbon not larger than 100 ppm in weight as impurity and having an averaged crystal particle diameter larger than 400 nm.

Raw material powder according to one aspect of the present invention is raw material powder to be sprayed toward a substrate and deposited on the substrate according to an aerosol deposition method, wherein the raw material powder contains an inorganic material, and an amount of carbon not larger than 100 ppm in weight as impurity.

According to the present invention, a film is formed according to the AD method by using raw material powder containing an amount of impurity, which generates a gas by being heated, less than a predetermined value, and therefore, an amount of the gas generating from inside of the film when heated can be reduced. Accordingly, separation of the film or generation of hillocks can be suppressed at the time of heat treatment of the film. Therefore, dense and high-quality films can be manufactured with high yield.

BRIEF DESCRIPTION OF THE DRAWINGS

Advantages and features of the present invention will be apparent by considering the following detailed description and the drawings in relation. In these drawings, the same reference numerals indicate the same component elements.

FIG. 10 shows results of heat treatment experiments on AD films fabricated by employing PZT raw material powder different in contained amounts of alkyl compounds;

BEST MODE FOR CARRYING OUT THE INVENTION

Figure 1:
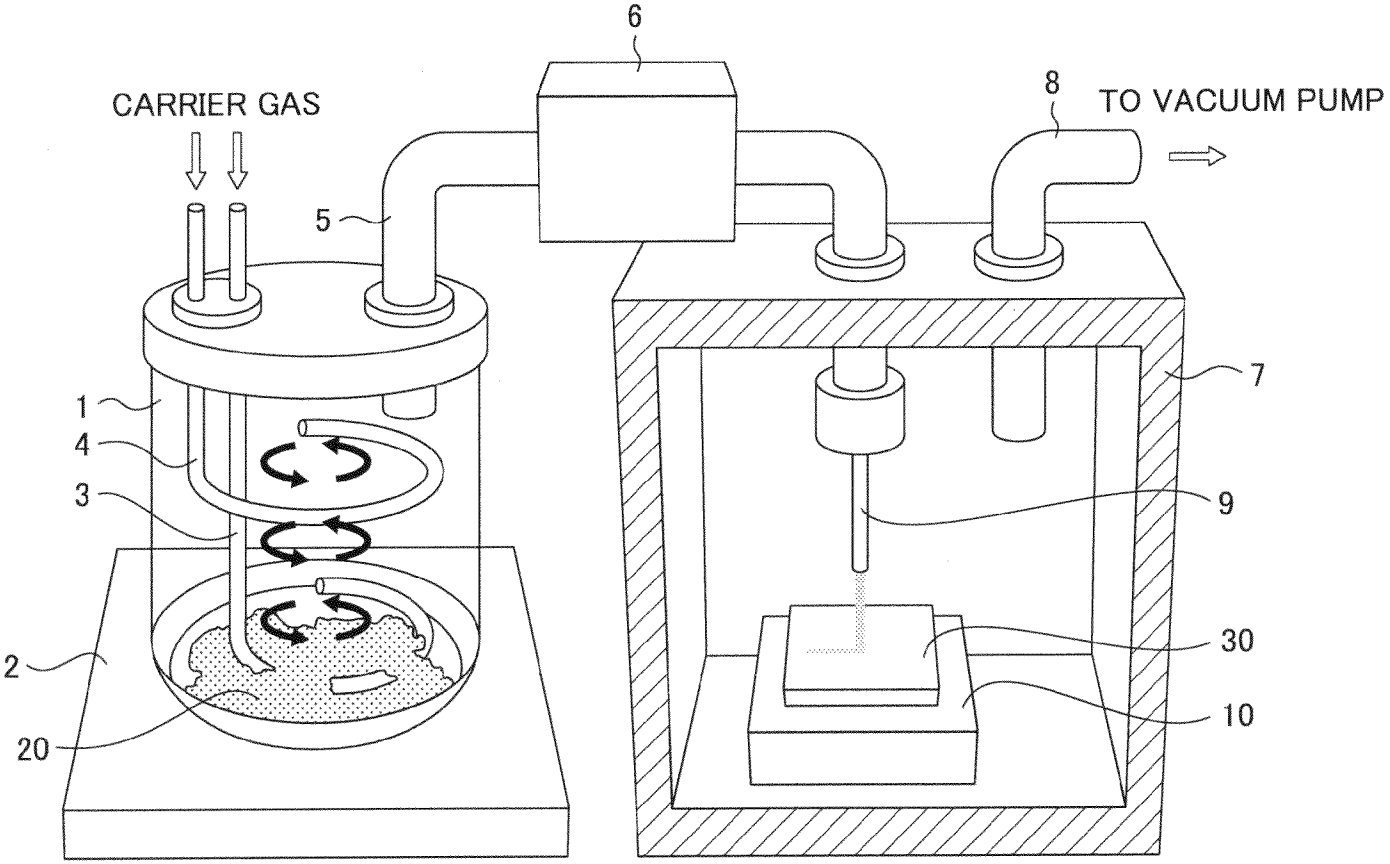
FIG. 1 is a schematic view showing a film forming apparatus according to the first embodiment of the present invention.

FIG. 1 is a schematic view showing a film forming apparatus using a method of manufacturing a composite structure according to the first embodiment of the present invention. The film forming apparatus has an aerosol generating unit and a film forming unit. As shown in FIG. 1, the aerosol generating unit includes an aerosol generation chamber 1, a vibration table 2, a raising gas nozzle 3 and a pressure regulating gas nozzle 4. The film forming unit includes a film formation chamber 7, an exhaust pipe 8, an injection nozzle 9 and a substrate stage 10. Further, the film forming apparatus has an aerosol carrier pipe 5 and a decarburizing processing unit 6 provided between the aerosol generating unit and the film forming unit. The aerosol carrier pipe 5 and the decarburizing processing unit 6 construct, together with the aerosol generating unit, the impurity removal processing apparatus.

In the aerosol generation chamber 1, an aerosol is generated. Further, the aerosol generation chamber 1 is mounted on the vibration table 2 that vibrates at a predetermined frequency for agitating raw material powder 20 placed within.

A compressed gas cylinder for supplying a carrier gas is connected to the raising gas nozzle 3. The raising gas nozzle 3 injects the gas supplied from the compressed gas cylinder into the aerosol generation chamber iso as to generate a cyclonic flow. Thereby, the raw material powder 20 placed in the aerosol generation chamber 1 is raised and dispersed to be aerosolized.

On the other hand, a compressed gas cylinder for supplying a carrier gas for regulating the pressure within the aerosol generation chamber 1 is connected to the pressure regulating gas nozzle 4. By adjusting the flow rate of the pressure regulating gas to control the pressure within the aerosol generation chamber 1, the speed of the air flow (raising gas) generated within the aerosol generation chamber 1 is controlled.

As the carrier gases supplied via the raising gas nozzle 3 and the pressure regulating gas nozzle 4, for example, a mixed gas of oxygen ($O_2$) and helium (He) is used. Alternatively, instead of helium, nitrogen ($N_2$), argon (Ar), or dry air may be used.

The aerosol carrier pipe 5 carries the aerosolized raw material powder within the aerosol generation chamber 1 to the nozzle 9 provided in the film formation chamber 7 via the decarburizing processing unit 6.

The decarburizing processing unit 6 corresponds to processing means for reducing the impurity adhering to or contained in the aerosolized raw material powder. Specifically, the impurity as a target of removal in the embodiment is carbon (C) or one or more compound containing carbon. This is because such a material generates $CO_2$ gas by being heated. The compounds containing carbon include alkyl compounds such as $C_{20}H_{42}$, $C_{20}H_4O$, $C_{22}H_{46}$ and $C_{24}H_{50}$. The alkyl compounds may be saturated or unsaturated. Further, the carbon number contained in one molecule is not especially limited. The configuration of the decarburizing processing unit will be explained in detail later.

The air within the film formation chamber 7 is exhausted by an exhaust pump connected to the exhaust pipe 8, and thereby, a predetermined degree of vacuum is kept.

The injection nozzle 9 has an opening having predetermined shape and size, and injects the aerosol supplied from the aerosol generation chamber 1 via the aerosol carrier pipe 5 from the opening toward a substrate 30 at a high speed.

The substrate stage 10 onto which the substrate 30 is fixed is a stage movable in a three-dimensional manner for controlling the relative position and the relative speed between the substrate 30 and the nozzle 9. By adjusting the relative speed, the thickness of a film formed by one reciprocating motion is controlled.

Figure 2:
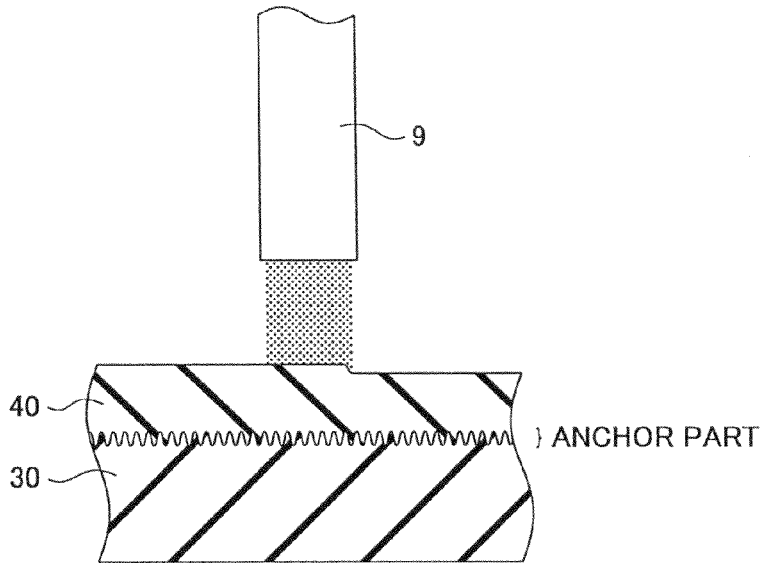
FIG. 2 is a sectional view showing a composite structure being fabricated in the film forming apparatus shown in FIG. 1.

In such a film forming apparatus, the raw material powder 20 is placed in the aerosol generation chamber 1 and the substrate 30 is set on the substrate stage 10 and kept at predetermined film formation temperature. Then, the film forming apparatus is driven such that the substrate 30 is moved at a predetermined speed while the aerosol is injected from the injection nozzle 9. Thereby, as shown in FIG. 2, the raw material powder collides with the substrate 30 and a structure previously deposited on the substrate, the particles bind together on the surfaces newly-formed by the deformation and/or crushing of the raw material powder at the time of collision, and the raw material powder is deposited on the substrate. Further, depending on the material of the substrate 30 (e.g., the case of a metal substrate or the like), sometimes the raw material powder cuts into the substrate and forms an anchor part. As a result, a structure (film) 40 is fabricated on the substrate 30.

Furthermore, thus fabricated structure 40 may be heat-treated together with the substrate 30 or separated from the substrate 30 and heat-treated. Thereby, the crystal grain growth can be promoted within the structure 40.

Next, the decarburizing processing that characterizes the method of manufacturing the composite structure according to the first embodiment of the present invention will be explained in detail.

In solid-phase sintering that is commonly used as a method of manufacturing a ceramic molded body, submicron-sized ceramic raw material powder is used. Although it is impossible that the ceramic raw material powder avoids organic contamination in the process of manufacture, the organic contamination is not so much problematic in the solid-phase sintering.

Figure 3A:
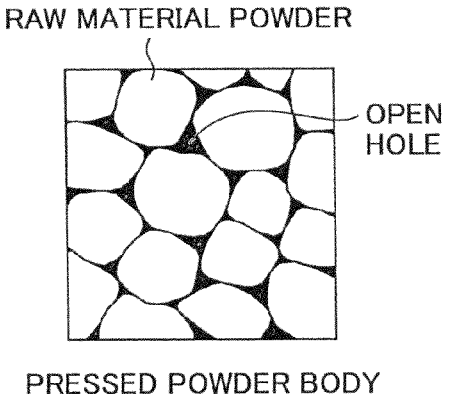
FIGS. 3A and 3B are schematic views showing structures of a sample when ceramic is fabricated by solid-phase sintering.

The reason is as follows. In the solid-phase sintering, first, a molded body, i.e., a pressed powder body is fabricated by packing the raw material powder. In this regard, typically, an organic binder is used for better formability of the pressed powder body. FIG. 3A is an enlarged view of the pressed powder body. As shown in FIG. 3A, there are holes between the packed raw material powder. The holes are open holes that communicate the interior and exterior of the pressed powder body.

Then, the pressed powder body is heat-treated at about 500° C. to 800° C. Thereby, organic materials existing in the pressed powder body are thermally decomposed and evaporate, and escape through the open holes to the outside of the pressed powder body. This is called a degreasing step. Generally, temperature rising process in the sintering step also serves as the degreasing step.

Figure 3B:
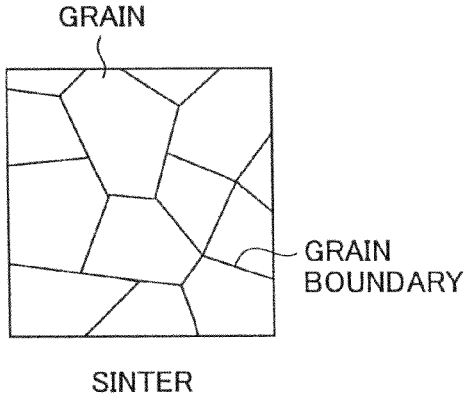

Furthermore, the pressed powder body is heat-treated (sintered) at higher temperature. Thereby, as shown in FIG. 3B, sintering of the raw material powder progresses. In the case of normal PZT, sintering starts from near 800° C. and is completed near 1200° C.

Thus, in the case of using solid-phase sintering, most organic contamination components and grease components such as binders in the raw material powder turn into carbon dioxide ($CO_2$) gas in the degreasing step and escape to the outside of the sample.

On the other hand, in the AD film, a film is formed by a room-temperature impact solidification phenomenon that the particles bind on the surfaces newly-formed due to collision of the raw material powder with the under layer. Therefore, the nature of the film is very dense and it is conceivable that almost no air hole (open hole) communicating from the interior to the exterior of the film exists. Accordingly, for example, even when the heat treatment (post-anneal) is performed on the AD film at 800° C. or more and the organic materials remaining in the AD film burn and gases such as $CO_2$ and so on are generated, holes (closed holes) are formed within the AD film because the gases cannot escape to the outside of the AD film. Then, the volume of the holes expand as the anneal temperature rises, and hillocks (abnormal cubical expansion generated in apart of the sample) are formed in the AD film. Alternatively, when such holes are formed at the boundary face between the substrate and the film, the film is separated from the film.

Figure 4A:
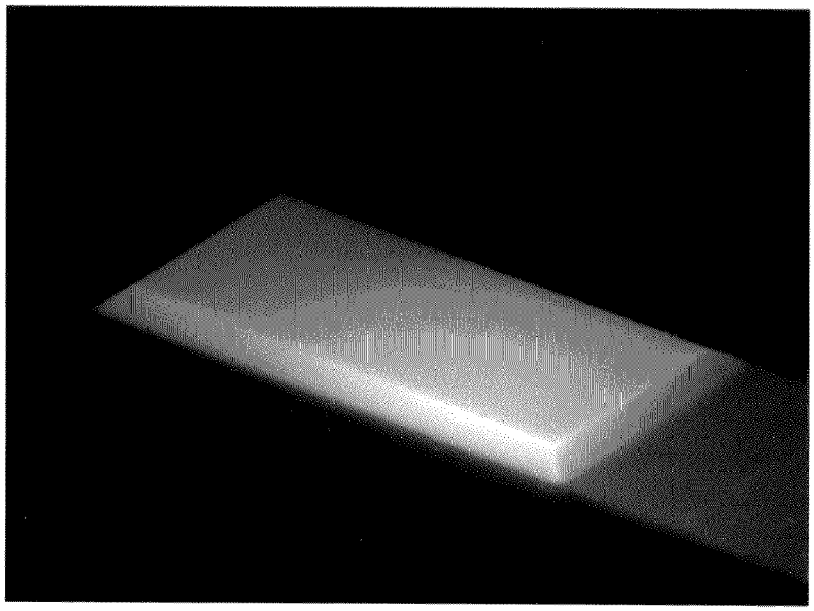
FIGS. 4A and 4B are photographs showing appearances before and after heat treatment of a PZT film fabricated by employing PZT raw material powder for solid-phase sintering (only subjected to drying processing)

Here, FIG. 4A shows an appearance of a PZT film having a thickness of about 500 μm formed on a substrate by using the AD method. As the substrate, an yttria-stabilized zirconia (YSZ) substrate on which a titanium oxide ($TiO_2$) film and a platinum (Pt) film are formed ($Pt/TiO_2/YSZ$ substrate) is used. Further, as raw material powder in the AD method, commercially available PZT raw material powder for general solid-phase sintering dried at 190° C., for example, is used. The decarburizing processing discussed as below (e.g., heat treatment at 800° C. for about ten minutes) or the like is not performed on the raw material powder. Furthermore, the substrate temperature is set to about 600° C. at the time of film formation by using the AD method.

Figure 4B:
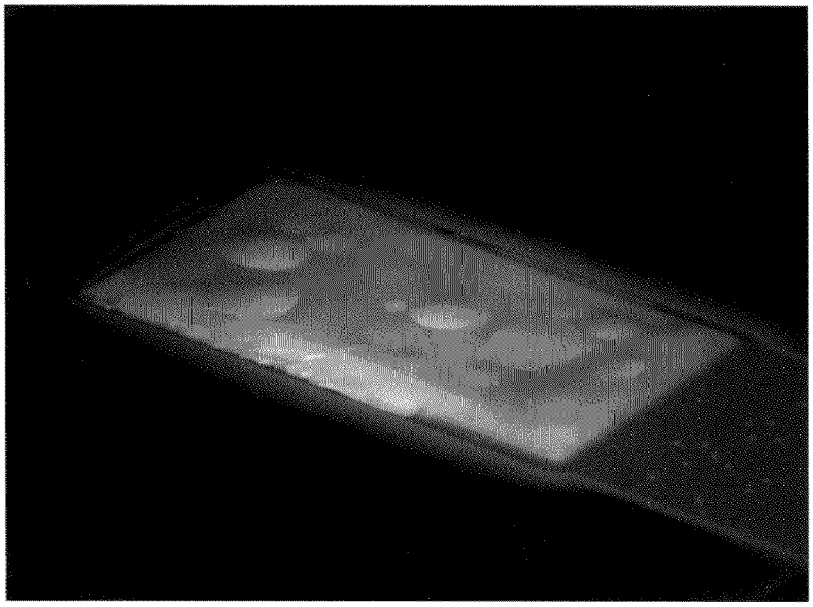

On the other hand, FIG. 4B shows an appearance after the PZT film (with substrate) shown in FIG. 4A is heat-treated in the air at about 1000° C. for about three hours. As shown in FIG. 4B, hillocks have been formed within the PZT film due to heat treatment. Thus, it can be said that hillock is a phenomenon derived from the characteristic film formation mechanism in the AD film.

Accordingly, in order to check the gas components generated when the AD film is heat-treated, the inventor of the present application has performed gas analysis (TPD-MS method) on the AD film (FIG. 4A) fabricated by using the PZT powder for solid-phase sintering.

Here, the amount of carbon contained in the PZT powder for solid-phase sintering after drying processing is 160 ppm. The amount of carbon is calculated based on the value obtained by measuring the amount of $CO_2$ gas generated when the PZT powder is burned in the high-frequency induction heating furnace according to the nondispersive infrared absorption method.

The analysis has been made in the following manner. That is, the PZT film sample is placed on a Pt boat disposed within the chamber, and the temperature is elevated by 20° C./min up to about 1000° C. while high-purity helium (He) gas flows by 40 cc/min, and held at 1000° C. for about five minutes, and then, cooled to room temperature. The gases generated during the process are continuously measured by using amass spectrometer. As the mass spectrometer, type AGS-7000 manufactured by ANELVA Corporation is used. Although the analysis has been performed on the AD film with the substrate, the substrate components have little influence on the analysis in the range of temperature during analysis because the $Pt/TiO_2/YSZ$ substrate has high heat resistance.

Figure 5A:
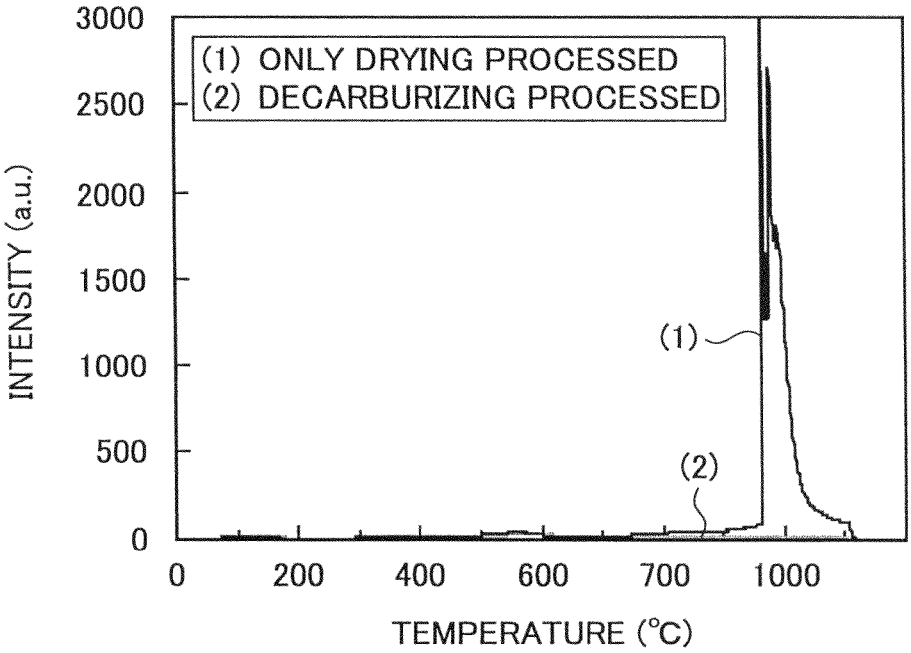
FIGS. 5A and 5B show comparisons between amounts of $CO_2$ gas generated from PZT film samples shown in FIGS. 4A and 9A.
Figure 5B:
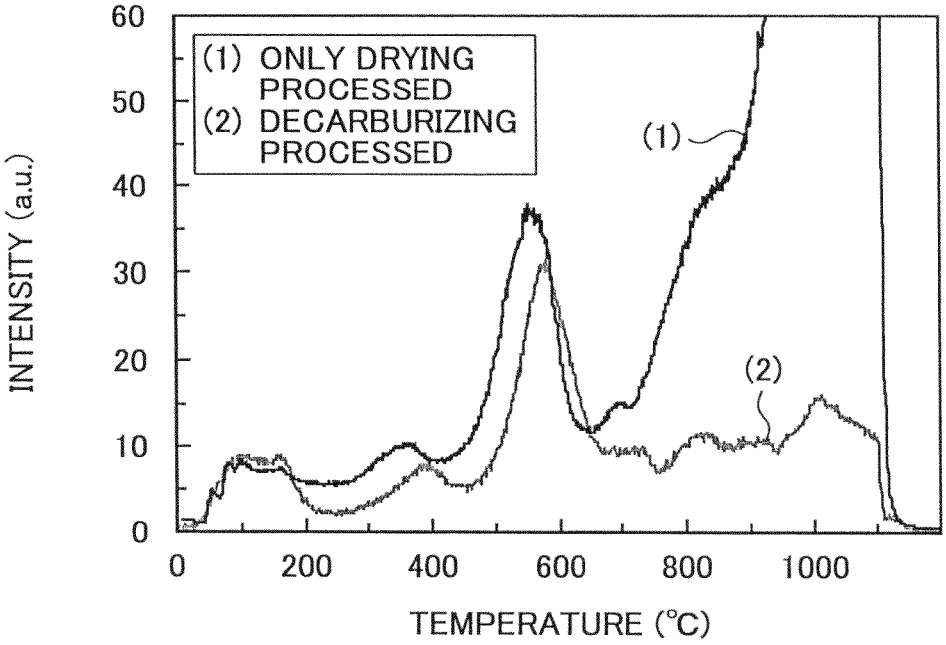

Curves (1) shown in FIGS. 5A and 5B indicate generation patterns of $CO_2$ gas generated from the sample as the TPD-MS analysis results for the sample shown in FIG. 4A. Here, the horizontal axes of FIGS. 5A and 5B indicate temperature changes during the TPD-MS analysis. Further, the unit of the vertical axes (intensity of $CO_2$ gas generation patterns) is an arbitrary unit (a.u.). FIGS. 5A and 5B are different only in the scale of the vertical axis. That is, FIG. 5A indicates the intensity shown by the vertical axis in a range within 3000 a.u., and FIG. 5B indicates the intensity shown by the vertical axis in a range within 60 a.u. The curves (2) will be described later.

As shown in FIG. 5B, in a region at a temperature of 800° C. or more, a large amount of $CO_2$ gas is generated from the PZT film sample formed by employing the raw material powder only subjected to drying processing. Further, as shown in FIG. 5A, large amounts of $CO_2$ gas are generated at several times at a temperature exceeding 900° C. From the fact, it is found that the hillock is a result from the cubical expansion of the holes formed by the $CO_2$ gas generated within the PZT film. Further, it can be explained that the $CO_2$ gas is sequentially emitted from the parts that become unbearable to inner pressure any more.

As shown in FIG. 4B, plural hillocks of varying sizes are formed in the PZT film sample after gas analysis. In consideration of the above analysis result, it can be said that these hillocks started to emerge when the film temperature reaches near 800° C.

In response to the results, the inventor of the present application has determined to check the materials adhering to the surfaces of the raw material powder or contained in the raw material powder used when the PZT film is fabricated by GC-MS (gas chromatography mass spectrometry) analysis in order to reveal the component that causes $CO_2$ gas generation. Here, the GC-MS is formed by combining a gas chromatograph and a mass spectrometer, and is an analyzer having both the separative power of mixture by the gas chromatograph and the qualitative power of the mass spectrometer. That is, the mixture sample is separated into plural kinds of materials by the gas chromatograph, and the materials are directly guided to the mass spectrometer for identification of the kinds of the materials. In the experiment, a mass spectrometer JMS-700M station manufactured by JEOL Ltd. is used.

The analysis has been performed in the following manner. First, commercially available raw material powder subjected to no special processing is washed away with hexane, and the hexane is condensed and analyzed by the GC-MS device. The amount of carbon contained in the raw material powder is separately measured as about 150 ppm. The method of the measurement and the device used therefor are the same as those explained as above.

Figure 6:
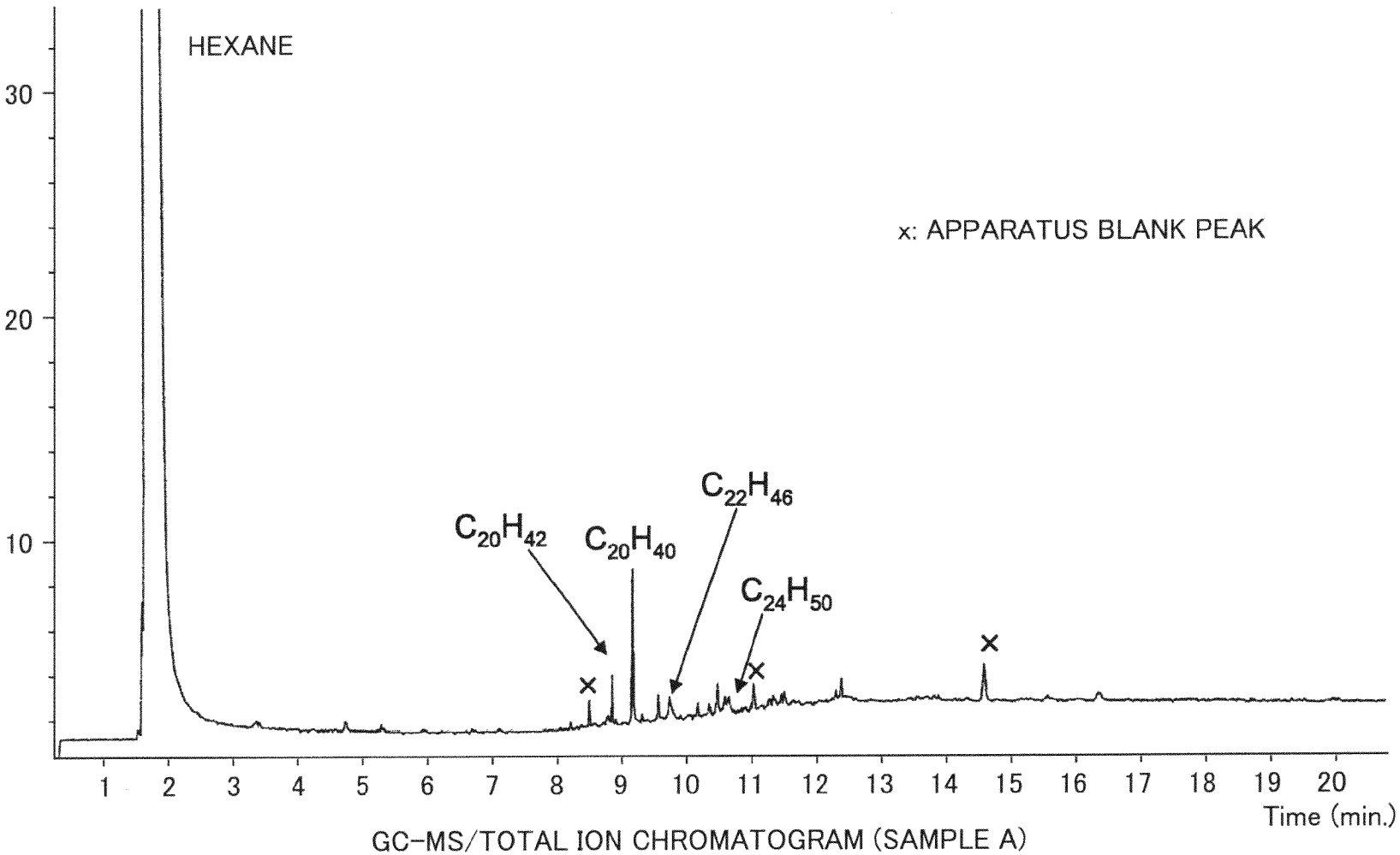
FIG. 6 shows a GC-MS analysis result for commercially available raw material powder.

FIG. 6 shows an analysis result. As shown in FIG. 6, it has been found that alkyl compounds such as $C_{20}H_{42}$, $C_{20}H_4O$, $C_{22}H_{46}$, and $C_{24}H_{50}$ adhere to the surfaces of the raw material powder (sample A). Here, it is not clear why such impurity (alkyl compounds) adhered to the raw material powder. However, little impurity could have adhered to the raw material powder immediately after fabrication because the raw material powder is fabricated at a temperature of about 800° C. Therefore, it is conceivable that oil mist floating in the air adhered to the raw material powder and impurity is mixed from a plastic container used when the raw material powder is stored or transported after the raw material powder is fabricated. It is conceivable that two peaks of $C_{20}H_4O$ appearing in FIG. 6 are caused by the existence of an isomer having a different double bond position or an isomer having a different branch structure.

Then, the inventor of the present application measured the amount of $CO_2$ generated from the raw material powder by using the TPD-MS analysis. As a sample, the raw material powder subjected to processing for reducing impurity (the above-mentioned alkyl compounds) or decarburizing processing, that is, the decarburizing processed raw material powder and the raw material powder not subjected to decarburizing processing, that is, the raw material powder only subjected to drying processing is used. The amount of carbon contained in the raw material powder only subjected to drying processing is 160 ppm. On the other hand, the decarburizing processing is performed by heating the raw material powder at about 800° C. for about ten minutes, and thereby, the amount of carbon contained in the raw material powder is reduced to about 60 ppm. Although the amount of carbon immediately after decarburizing processing is actually much smaller, about several tens of ppm of carbon is detected because organic materials and $CO_2$ gas adhere to the surface of the raw material powder during the period before analysis. Further, the method of the TPD-MS analysis and the device used therefor are the same as those explained as above.

Figure 7:
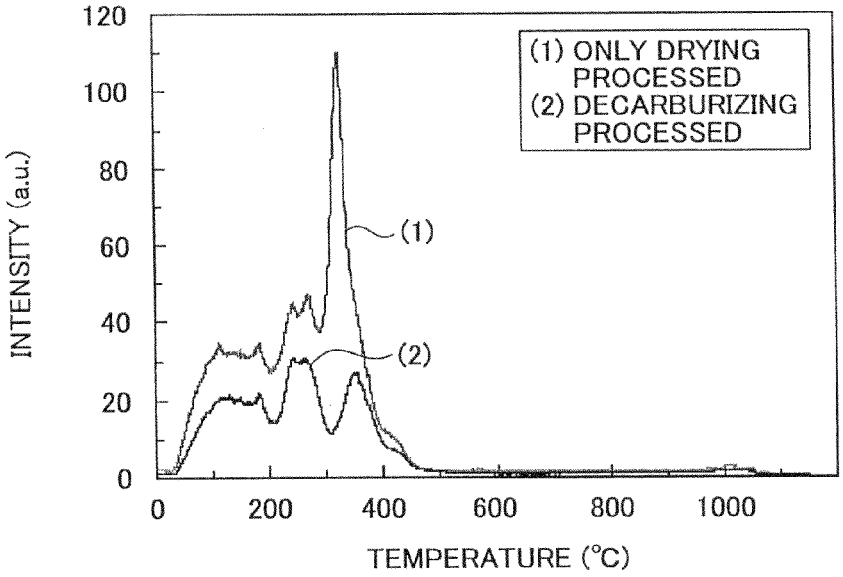
FIG. 7 shows a comparison between amounts of $CO_2$ gas generated from raw material powder only subjected to drying processing and decarburizing processed raw material powder.

Thereby, results shown in FIG. 7 have been obtained. Here, the horizontal axis of FIG. 7 indicates the temperature change during the TPD-MS analysis, and the vertical axis indicates intensity (arbitrary unit: a.u.). As shown in FIG. 7, great differences appeared in the $CO_2$ gas generation patterns depending on whether or not the decarburizing processing is performed on the raw material powder. That is, $CO_2$ gas of 330 μL/g is generated from the raw material powder only subjected to the drying processing, i.e., not subjected to the decarburizing processing, while the $CO_2$ gas generated from the decarburizing processed raw material powder is reduced to 170 μL/g. From the experiment, it has become clear that the amount of carbon contained in the raw material powder correlates with the amount of $CO_2$ gas generated from the raw material powder. Here, in the case where the impurities are carbon as an element, the amount of carbon contained in the raw material powder refers to an amount of carbon as an element. On the other hand, in the case where the impurities are alkyl compounds, the amount of carbon refers to an amount of carbon contained in the impurities.

Figure 8:
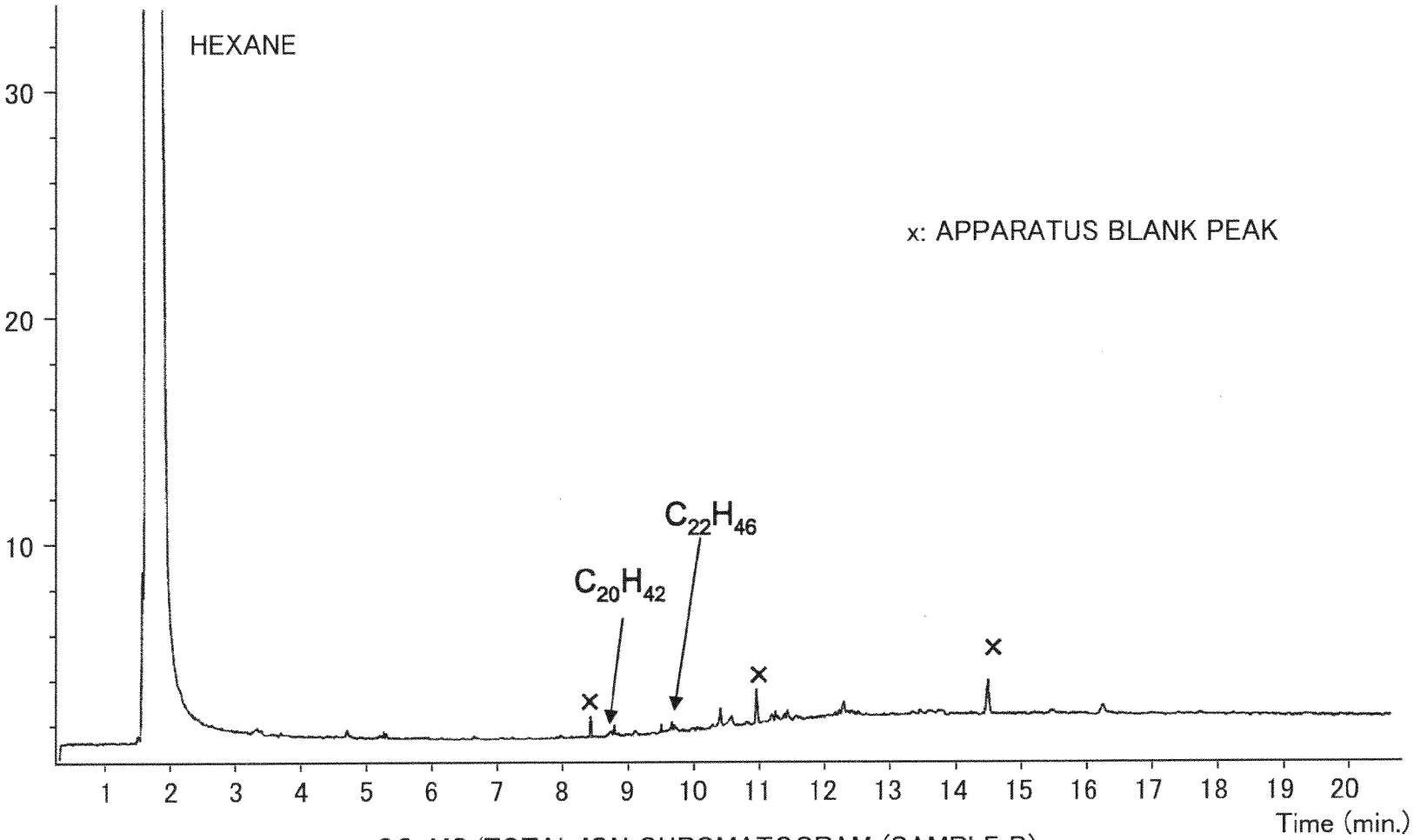
FIG. 8 shows a GC-MS analysis result for the decarburizing processed raw material powder.

Furthermore, the inventor of the present application checked the kinds of impurity adhering to or contained in the raw material powder by performing GC-MS analysis on the decarburizing processed raw material powder. The amount of carbon contained in the raw material powder is separately measured by as 100 ppm or less. As shown in the analysis result in FIG. 8, only $C_{20}H_{42}$ and $C_{22}H_{46}$ have been slightly detected from the decarburizing processed raw material powder (sample B) but other alkyl compound has been hardly detected. From the results shown in FIGS. 6-8, it has become clear that the impurity contained in the raw material powder and generating $CO_2$ gas by being heated includes mainly alkyl compounds, and such impurity can be reduced by performing decarburizing processing on the raw material powder.

Accordingly, the inventor of the present application has fabricated a PZT film by employing the decarburizing processed raw material powder and performed TPD-MS analysis on the PZT film.

The decarburizing processing of raw material powder is performed by heating PZT powder for solid-phase sintering at about 800° C. for about ten minutes, and thereby, the amount of carbon contained in the PZT powder is reduced to about 60 ppm. By employing the raw material powder, a PZT film having a thickness of about 300 μm has been fabricated on a $Pt/TiO_2/YSZ$ substrate according to the AD method. At that time, the substrate temperature is set to 600° C.

Figure 9A:
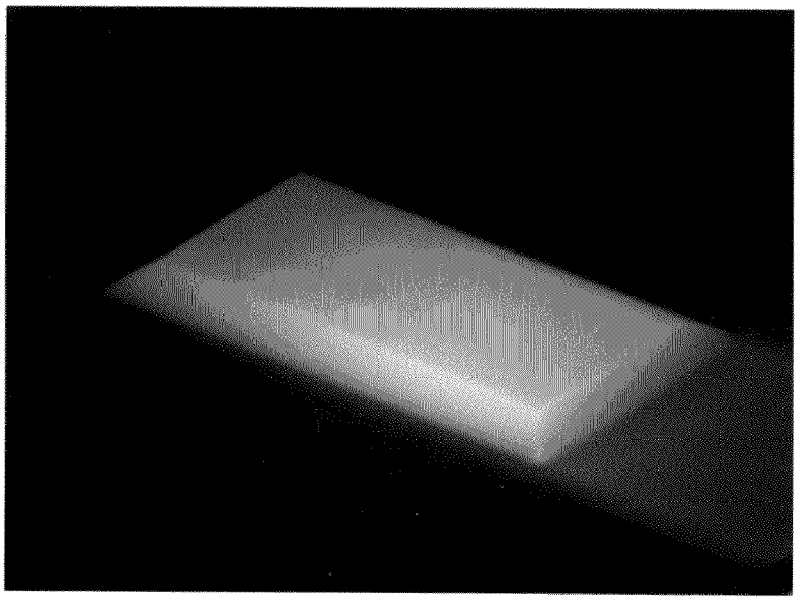
FIGS. 9A and 9B are photographs showing appearances before and after heat treatment of a PZT film fabricated by employing the decarburizing processed PZT raw material powder.

FIG. 9A shows an appearance of thus fabricated AD film. The method of the TPD-MS analysis and the device used therefor are the same as those explained as above.

Curves (2) shown in FIGS. 5A and 5B indicate generation patterns of $CO_2$ gas generated from the sample as the TPD-MS analysis results for the sample shown in FIG. 9A. As shown in FIG. 5B, both the curves (1) and (2) behave in the same way up to a temperature near 600° C. However, as indicated by the curve (2) in FIG. 5A, the amount of gas generated from the PZT film sample by employing the decarburizing processed raw material powder is very small at a temperature exceeding 600° C.

Figure 9B:
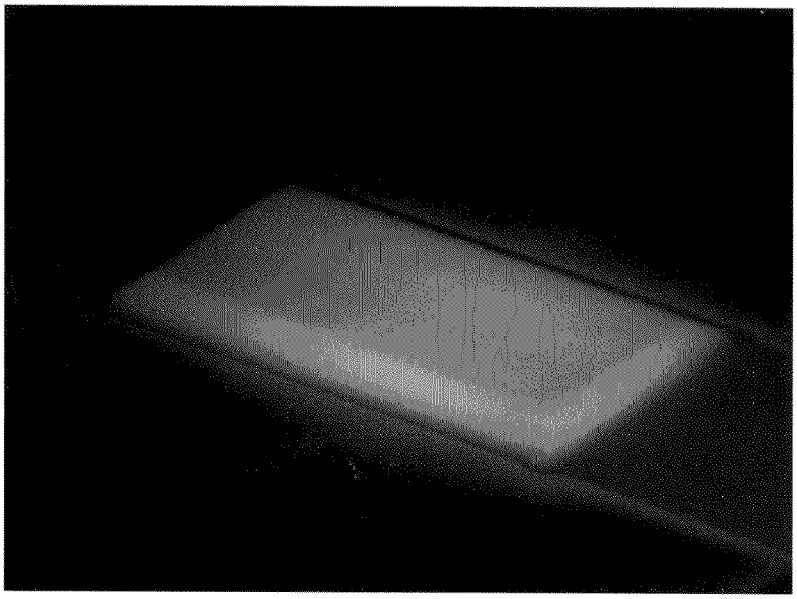

Further, FIG. 9B shows an appearance of the sample after the gas analysis (heat treatment). As shown in FIG. 5B, even when the PZT film sample fabricated by employing the decarburizing processed raw material powder is heated up to a high temperature, there is no hillock generated in the film or no separation of the film from the substrate.

As explained above, since the impurities, i.e., carbon or a compound containing carbon (alkyl compound) included in the raw material powder is sufficiently removed in advance, when the AD film is post-annealed, a film with good quality without hillocks can be fabricated. Here, in the AD method, raw material powder for solid-phase sintering before added with a binder is often used, and the raw material powder often contains a large amount of alkyl compounds. Therefore, it is necessary to grasp the feature of the raw material powder before film formation, and perform decarburizing processing when the raw material powder contains large amount of alkyl compounds. An alkyl compound containing eighteen or more carbons in one molecule may be called a long-chain alkyl compound.

FIG. 10 shows results of heat treatment experiments on AD films fabricated by employing plural kinds of PZT raw material powder containing different amounts of alkyl compounds. In FIG. 10, the amounts of alkyl compounds contained in the respective AD films are represented indirectly by carbon contents obtained by carbon analysis. That is, the amount of $CO_2$ gas generated when the PZT raw material powder is burned is measured in the high-frequency induction heating furnace according to the nondispersive infrared absorption method, and the carbon contents are calculated based on the measurement value.

In FIG. 10, as each of anneal conditions (1) to (5), anneal temperature (° C.) and anneal time (h) are shown. Further, the numerical value of each of the AD films (a) to (e) represents carbon content (ppm) in the AD film. Furthermore, a circle in the table indicates that neither separation nor hillock is generated.

As shown in FIG. 10, the larger the carbon content (amount of alkyl compounds incorporated in the AD film), the more easily the separation and hillocks are generated. Further, as indicated in the AD films (b) and (c), it is found that, when the raw material powder is the same, the higher the anneal temperature, the more easily the hillocks are generated. Furthermore, as indicated by the anneal conditions (3) to (5), it is found that, as the carbon content is increased, first, hillocks are generated, and, as the carbon content is further increased, separation occurs.

As described above, the following results can be obtained. That is, when the carbon content in the AD film is about 150 ppm or less, even in the case of performing high-temperature anneal processing at a temperature of about 1000° C., the separation of the film can be prevented. Further, when the carbon content in the AD film is about 100 ppm or less, even in the case of performing high-temperature anneal processing, both separation of the film and hillocks can be prevented.

Figure 11:
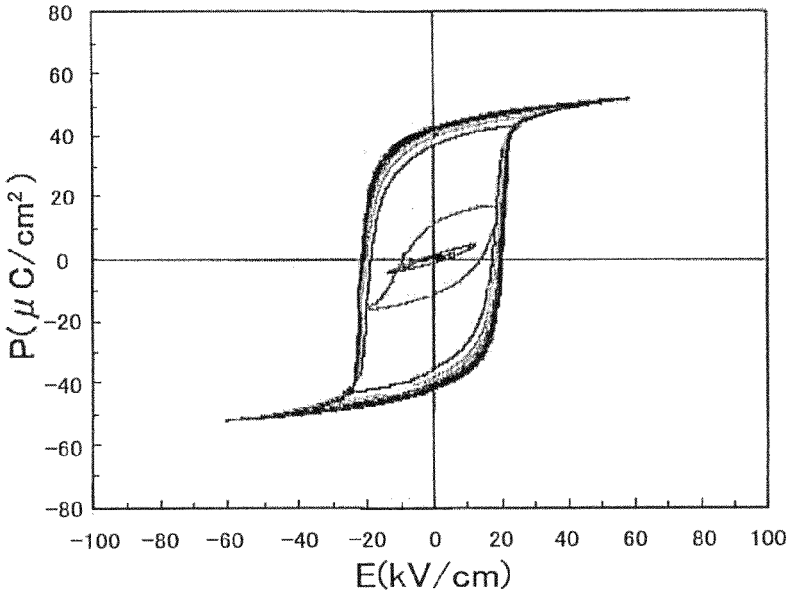
FIG. 11 shows electrostatic characteristics of a PZT film manufactured by using a method of manufacturing a composite structure according to the first embodiment of the present invention.

Here, improvement of characteristics due to heat treatment (post-anneal) at a high temperature will be explained. In the case where PZT is employed as a film forming material, when the anneal processing temperature exceeds 950° C., a ratio of pseudo cubic crystal (or rhombohedral crystal) decreases while a ratio of tetragon crystal increases, and thereby, electrostatic characteristics (piezoelectric characteristics) are improved. Further, when the anneal processing temperature reaches 1000° C., a ratio of tetragon crystal exceeds 50% to become superior and ferroelectricity appears as shown in FIG. 11. In FIG. 11, the horizontal axis indicates intensity of electrical field E (kV/cm), and the vertical axis indicates intensity of dielectric polarization ($\mu C/cm^2$). In this case, an average grain size of the PZT film is about 0.42 μm.

Figure 12:
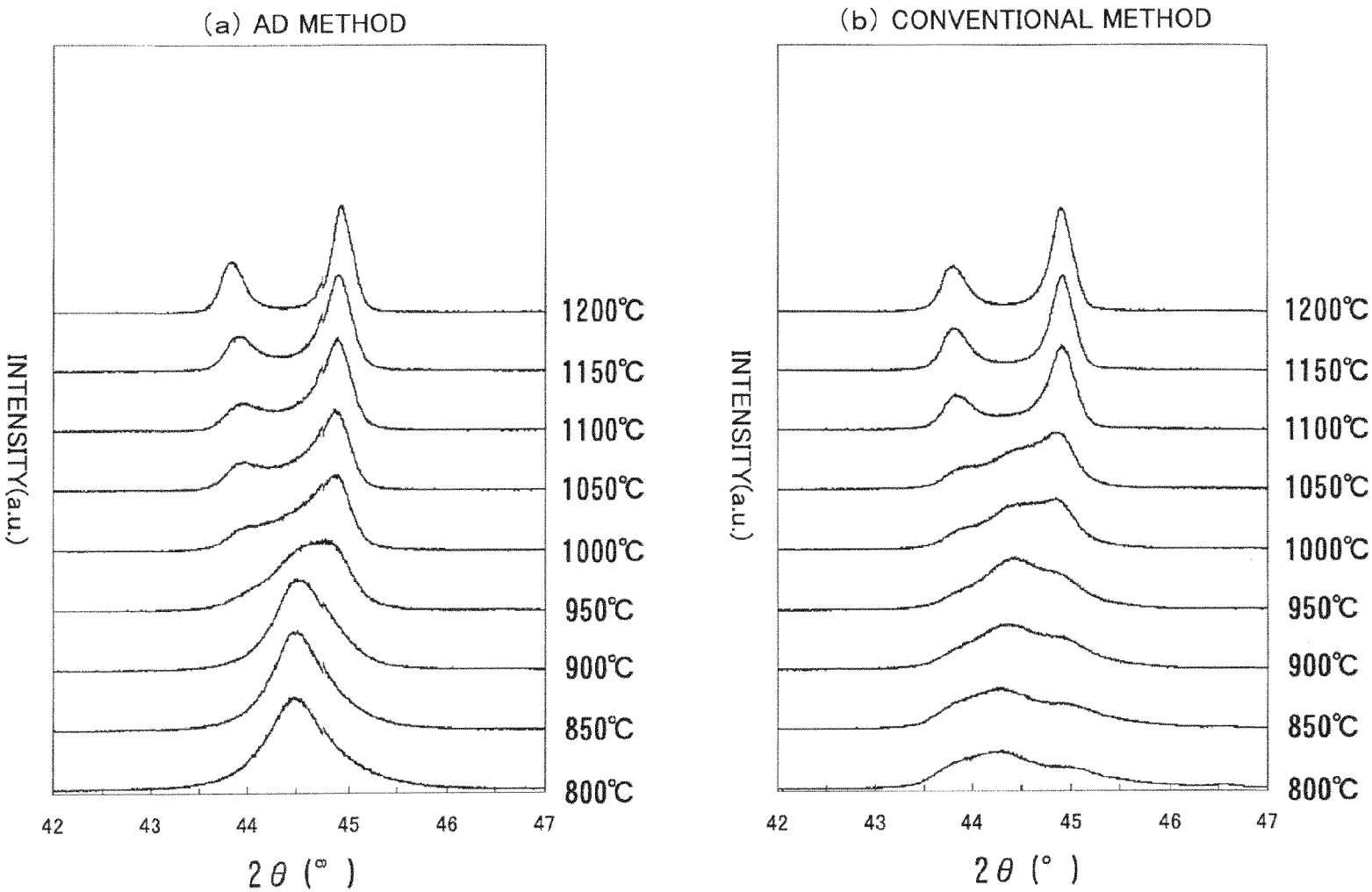
FIG. 12 shows results of X-ray diffraction in PZT films (a) manufactured by using a method of manufacturing a composite structure according to the first embodiment of the present invention and PZT films (b) manufactured by using a conventional method.

FIG. 12 shows results of X-ray diffraction in PZT films (a) manufactured by using a method of manufacturing a composite structure according to the first embodiment of the present invention and bulk PZT films (b) manufactured by using a conventional method. In FIG. 12, the horizontal axis indicates an X-ray diffraction angle 2θ(°), and the vertical axis indicates X-ray intensity (arbitrary unit: a.u.). Further, in FIG. 12, by using the anneal processing temperature as a parameter, there are shown results of X-ray diffraction in PZT films performed with the anneal processing at respective temperatures. In those results of X-ray diffraction, in the case where one peak appears in the X-ray intensity, the pseudo cubic crystal (or rhombohedral crystal) has a large percentage, while in the case where two peaks appear in the X-ray intensity, the tetragon crystal has a large percentage. Therefore, it is seen that the tetragon crystal is apt to appear from a lower temperature in the PZT films manufactured by using the method according to the first embodiment of the present invention than those manufactured by using the conventional method.

By the way, in film formation according to the AD method, PLZT (lanthanum doped lead zirconate titanate), in which lanthanum is added to PZT, may be used other than PZT. By adding lanthanum to PZT, the crystal structure becomes more and more like cubic crystal and electrostatic characteristics degrade, however, PLZT is transparent and can be used as optical materials. The PZT films manufactured by using the method according to the embodiment also acquires high transparency when the anneal processing temperature exceeds 1000° C.

Figure 13:
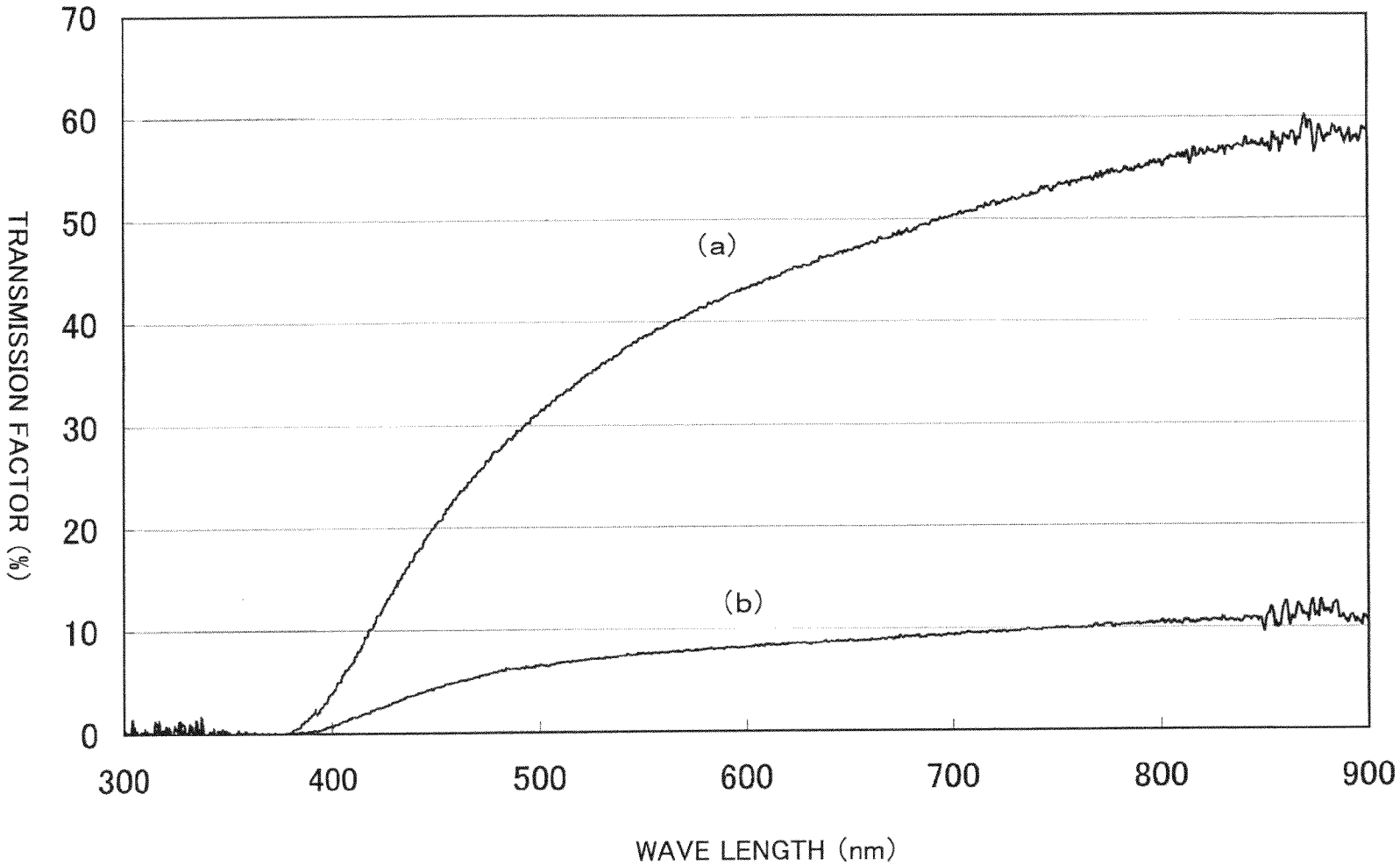
FIG. 13 shows light transmission characteristics in a PZT film (a) manufactured by using a method of manufacturing a composite structure according to the first embodiment of the present invention and a PZT film (b) manufactured by using a conventional method.

FIG. 13 shows light transmission factor characteristics in a PZT film (a) manufactured by using a method of manufacturing a composite structure according to the first embodiment of the present invention and a PZT film (b) manufactured by using a conventional method. In FIG. 13, the horizontal axis indicates a wavelength of light (nm), and the vertical axis indicates a light transmission factor (%). The PZT film manufactured by using the method according to the embodiment has been performed with the anneal processing at a temperature of 1000° C., while the PZT film manufactured by using the conventional method has been performed with the anneal processing at a temperature of 1200° C. Both those PZT film have the same thickness of 300 μm. As shown in FIG. 13, the PZT film manufactured by using the method according to the embodiment has a superior light transmission factor in a wide range of wavelength than that manufactured by using the conventional method.

Figure 14:
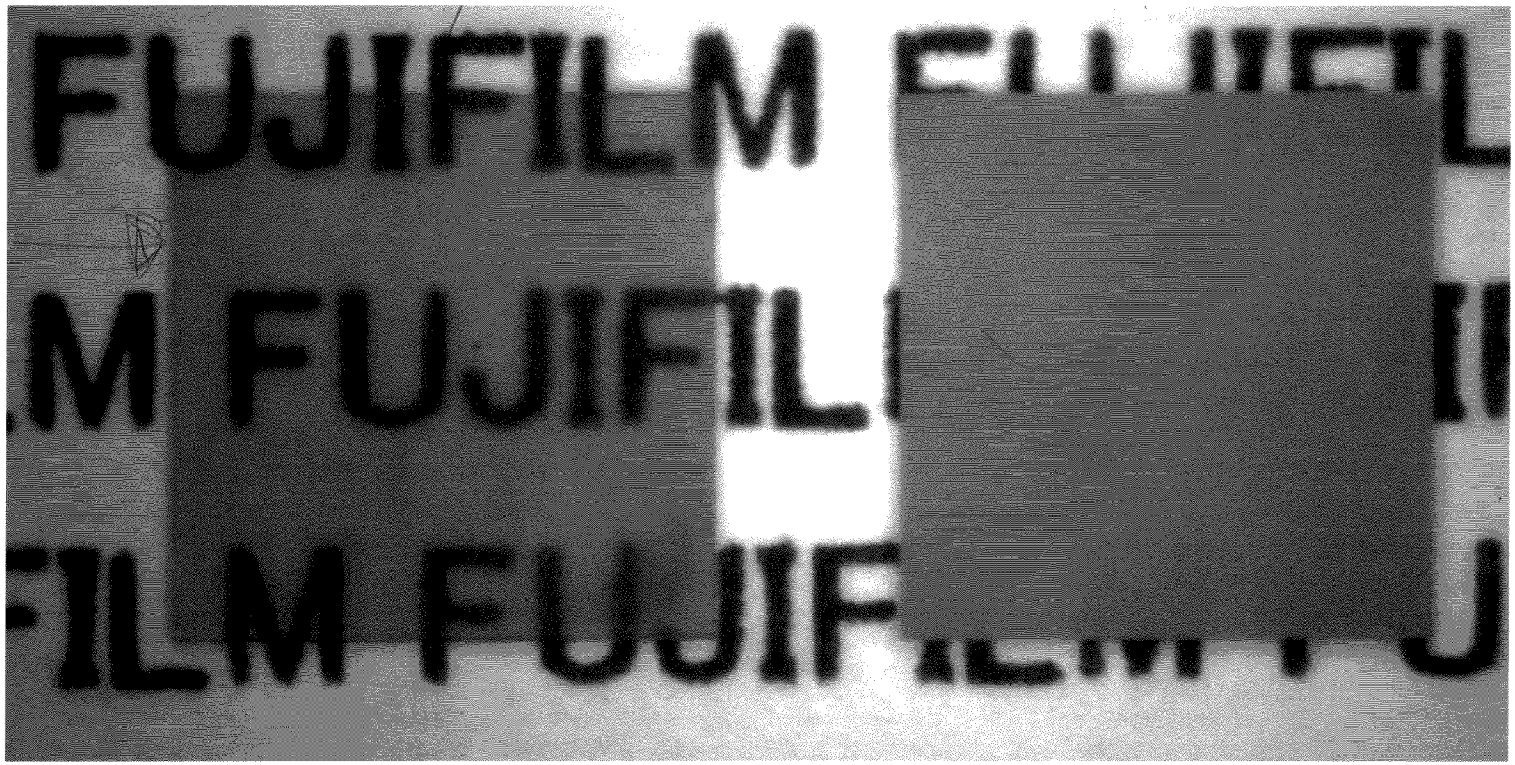
FIG. 14 is a photograph for comparing transparency between a PZT film (a) manufactured by using a method of manufacturing a composite structure according to the first embodiment of the present invention and a PZT film (b) manufactured by using a conventional method.

FIG. 14 is a photograph for comparing transparency between a PZT film (a) manufactured by using a method of manufacturing a composite structure according to the first embodiment of the present invention and a PZT film (b) manufactured by using a conventional method. In FIG. 14, on a groundwork, in which "FUJIFILM" is repeatedly printed, the PZT film manufactured by using the method according to the embodiment is placed on the left-hand side, and the PZT film manufactured by using the conventional method is placed on the right-hand side. Both those PZT film have the same thickness of 300 μm. As shown in FIG. 14, the PZT film manufactured by using the method according to the embodiment has a superior transparency than that manufactured by using the conventional method.

As described above, according to the embodiment, it becomes possible to perform heat treatment at a high temperature for a PZT film manufactured by using the AD method, and as a result, the PZT film can be manufactured that has a high ratio of the tetragon crystal, that is transparent, and that indicates ferroelectricity.

Next, specific configuration examples of the decarburizing processing unit 6 as shown in FIG. 1 will be explained.

Figure 15:
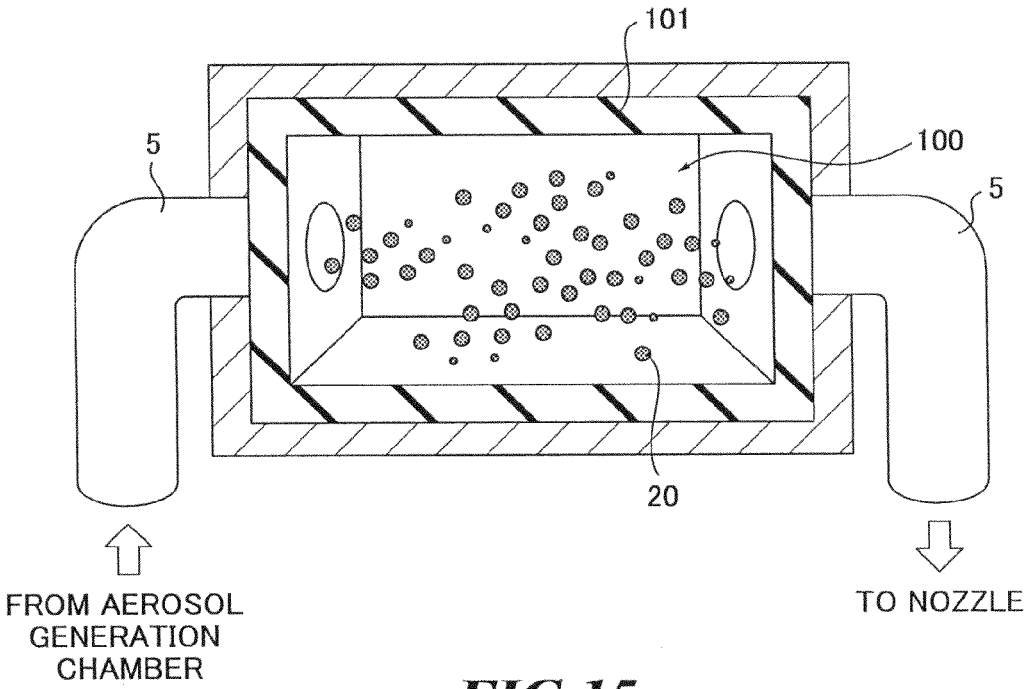
FIG. 15 is a schematic view showing a first configuration example of the decarburizing processing unit shown in FIG. 1.

FIG. 15 is a schematic view showing a first configuration example of the decarburizing processing unit 6 as shown in FIG. 1.

As shown in FIG. 15, for example, an electric heater 101 is provided on the inner walls of a processing chamber 100. An aerosol in which raw material powder is dispersed in a suitable gas is introduced into such an electric furnace (the processing chamber 100 and the electric heater 101) and heated (provisionally baked). As a carrier gas, a suitable gas is selected or suitable gases are combined from among atmospheric air, oxygen ($O_2$), argon (Ar), helium (He), nitrogen ($N_2$), hydrogen ($H_2$), water vapor ($H_2O$) and so on according to the composition of the raw material powder, and used. Thereby, carbon or organic material contamination adhering to or contained in the raw material powder 20 reacts with the oxygen in the carrier gas and escapes from the raw material powder 20 as carbon monoxide (CO), carbon dioxide ($CO_2$) or water ($H_2O$).

According to the decarburizing processing unit shown in FIG. 15, the decarburizing processing is performed in the simple apparatus configuration, and raw material powder containing little amount of impurity such as carbon as an element or alkyl compounds, i.e., raw material powder suitable for the AD method can be fabricated. Further, such raw material powder can be fabricated in a large amount at one time by using a large-scaled electric furnace and stored. Note that, when heating, it is necessary to control the temperature of the heater 101 such that the temperature of the raw material powder 20 may not reach the melting point or above.

Further, generally, the smaller the carbon number contained in one molecule as in, for example, so-called short-chain or medium-chain alkyl compound having a carbon number less than 18, the more easily the alkyl compound escapes from the raw material powder. As the carbon number is larger as in so-called long-chain alkyl compound, it becomes more difficult for the alkyl compound to escape from the raw material powder. Therefore, the temperature control may be performed according to the composition of the impurities.

Figure 16:
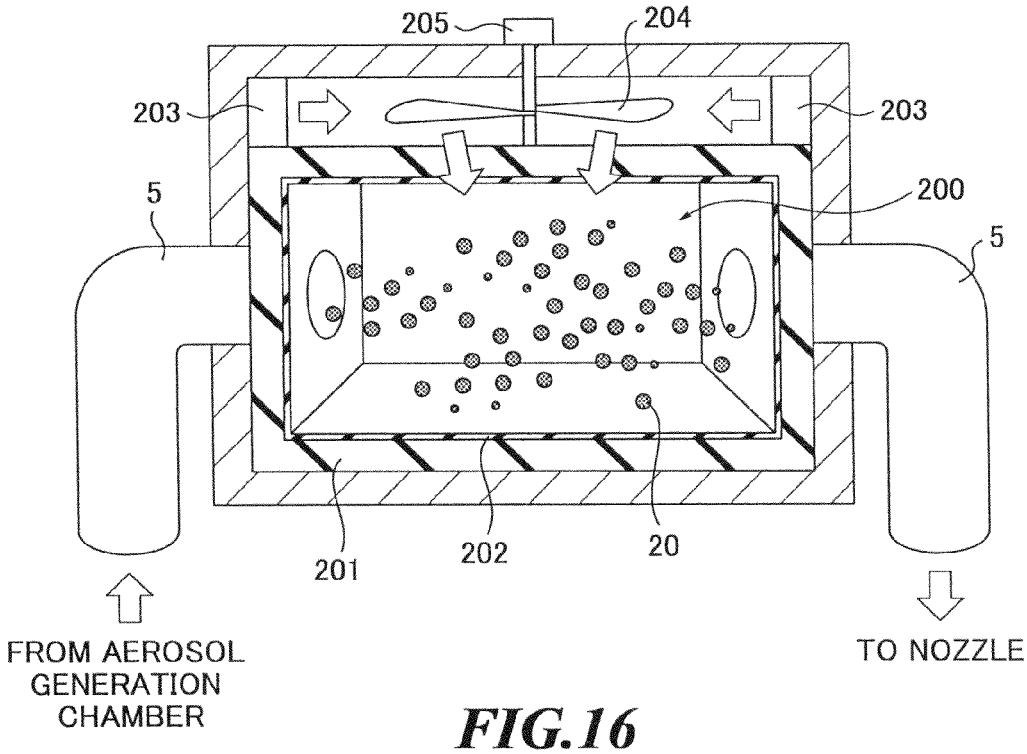
FIG. 16 is a schematic view showing a second configuration example of the decarburizing processing unit shown in FIG. 1.

FIG. 16 is a schematic view showing a second configuration example of the decarburizing processing unit 6 as shown in FIG. 1.

As shown in FIG. 16, a processing chamber 200 is formed by employing a heat insulating material 201 and an isothermal barrier 202. Further, the decarburizing processing unit 6 is provided with a microwave oscillator 203, a rotary blade 204 and a motor 205. Here, microwave is electromagnetic wave having a wavelength of about 1 m to 1 mm, and includes UHF wave (decimeter wave), SHF wave (centimeter wave), EHF wave (millimeter wave) and submillimeter wave. Further, the isothermal barrier refers to a refractory lining formed by employing a material having absorbability of microwave at the same level as that of an object to be heated (raw material powder in the embodiment).

The rotary blade 204 is mounted so as to rotate by driving of the motor 205. Further, the rotary blade 204 is formed by employing a material that reflects microwave (e.g., metal), and reflects the microwave emitted from the microwave oscillator 203 toward the processing chamber 200. In this regard, the reflection direction of the microwave is constantly changed by rotating the rotary blade 204, and thus, application region of microwave is prevented from becoming uneven.

In such a decarburizing processing unit, the microwave oscillator 203 and the motor 205 are driven, and an aerosol, in which raw material powder is dispersed in a suitable gas, is introduced into the processing chamber 200 via the aerosol carrier pipe 5. The composition of the carrier gas is the same as that explained in the first configuration example. Thereby, the isothermal barrier 202 applied with microwave is heated and the temperature within the processing chamber 200 is elevated uniformly. Further, also the aerosolized raw material powder 20 is directly heated by being applied with microwave. As a result, carbon or the organic contamination adhering to or contained in the raw material powder 20 reacts with the oxygen in the carrier gas and escapes from the raw material powder 20 as carbon monoxide (CO), carbon dioxide ($CO_2$) or water ($H_2O$). Note that, when heating, it is necessary to control the intensity of the microwave such that the temperature of the raw material powder 20 may not reach the melting point or above.

In the configuration example, the oxygen gas is mixed to the carrier gas in order to prevent the occurrence of oxygen loss in the composition of the raw material powder. That is, when there is no oxygen in the atmosphere for decarburizing processing, carbon or the alkyl compounds adhering to or contained in the raw material powder reacts with the oxygen in the composition of the raw material powder (e.g., PZT), and therefore, it is necessary to suppress such reaction.

Thus, according to the decarburizing processing unit shown in FIG. 16, microwave is applied to the raw material powder 20 within the processing chamber 200 that has been uniformly heated, and the raw material powder 20 can be evenly and effectively heated. Thereby, the decarburizing processing can be performed efficiently in a short period, and the agglomeration of the raw material powder or the like hardly occurs during the decarburizing processing, and finally, raw material powder (aerosol) in which the amount of impurity has been significantly reduced can be obtained.

Figure 17:
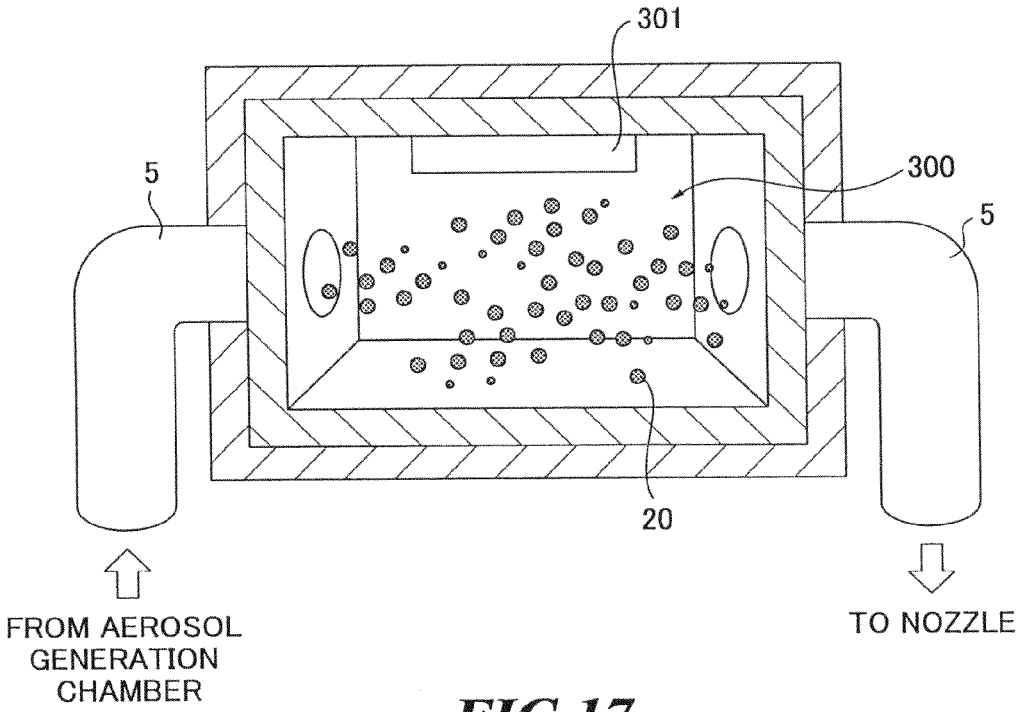
FIG. 17 is a schematic view showing a third configuration example of the decarburizing processing unit shown in FIG. 1.

FIG. 17 is a schematic view showing a third configuration example of the decarburizing processing unit 6 as shown in FIG. 1.

As shown in FIG. 17, a plasma generator 301 is provided in a processing chamber 300. Here, plasma refers to clusters of charged particles of ions, electrons and so on electrolytically dissociated by high energy application to a material. In the plasma, the material has higher energy and is activated, and thus, easily reacts with other materials. Plasma cleaning utilizing such a nature of plasma is generally used in the technical fields of electric component manufacturing, semiconductor manufacturing and so on.

An aerosol using oxygen gas as a carrier gas is introduced into the processing chamber 300, and the plasma generator 301 is operated. Thereby, plasma is generated within the processing chamber 300, and activated oxygen ions are generated. Carbon or the organic contamination adhering to or contained in the raw material powder 20 reacts with the oxygen ions and escapes from the raw material powder 20 as carbon monoxide (CO), carbon dioxide ($CO_2$) or water ($H_2O$).

According to the decarburizing processing unit shown in FIG. 17, decarburizing processing can be performed without heating but with high efficiency, and thus, there is an advantage that the crystal structure of the raw material powder or the like is hardly affected. Therefore, a structure can be formed by employing high-quality raw material powder in which an amount of impurity has been significantly reduced.

Figure 18:
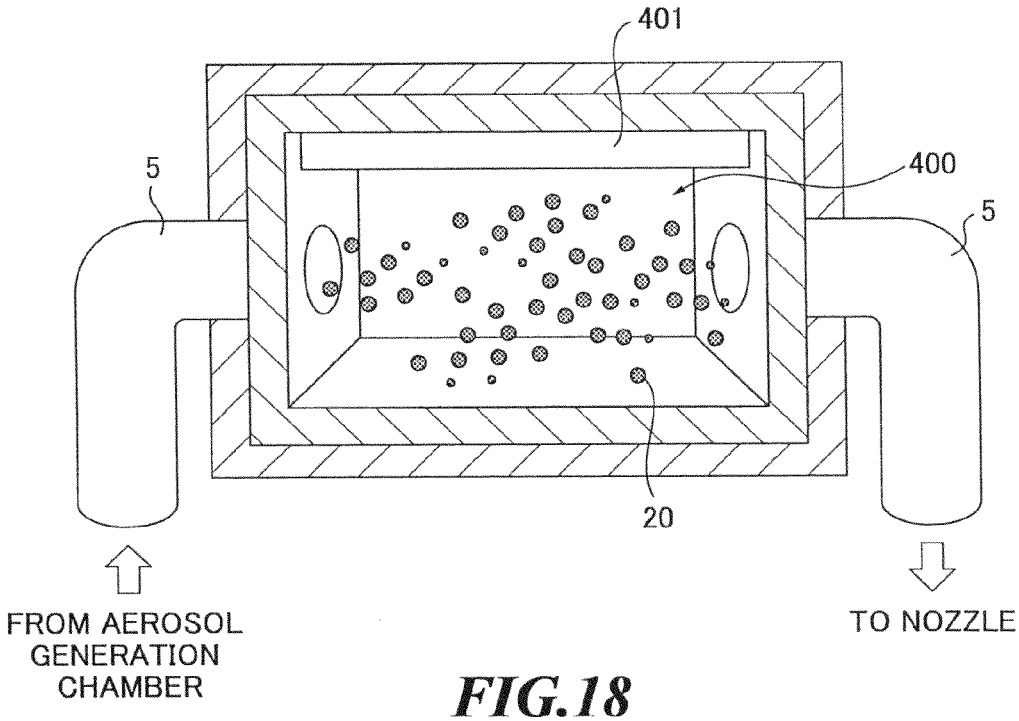
FIG. 18 is a schematic view showing a fourth configuration example of the decarburizing processing unit shown in FIG. 1.

FIG. 18 is a schematic view showing a fourth configuration example of the decarburizing processing unit 6 as shown in FIG. 1. The decarburizing processing unit is characterized by performing decarburizing processing by UV (ultraviolet) cleaning. The UV cleaning is generally used in the technical fields of semiconductor manufacturing and so on.

As shown in FIG. 18, an ultraviolet lamp 401 is provided in a processing chamber 400. An aerosol using helium gas and oxygen gas as a carrier gas is introduced into the processing chamber 400, and the ultraviolet lamp 401 is operated to apply ultraviolet light. By the ultraviolet energy, the bonding of carbon or the organic materials adhering to the surface of the raw material powder 20 or contained in the raw material powder 20 is broken. Further, the ultraviolet light is absorbed by oxygen in the carrier gas and ozone ($O_3$) is generated, and furthermore, oxygen atoms in an excited state are generated. Carbon or the organic contamination on the surface of the raw material powder 20 reacts with the oxygen atoms in the excited state and escapes from the raw material powder 20 as carbon monoxide (CO), carbon dioxide ($CO_2$) or water ($H_2O$).

Alternatively, in place of the ultraviolet lamp 401, a device that generates vacuum ultraviolet light (VUV) may be used. The vacuum ultraviolet light refers to light having a shorter wavelength within a range from about 100 nm to about 200 nm among ultraviolet light generally having a wavelength within a range from about 10 nm to about 400 nm. The vacuum ultraviolet light is typically used for the application of cleaning of semiconductor wafers, room-temperature anneal of organic films, surface reforming of resin materials and so on, and able to efficiently photodegrade or desorb organic contamination materials. Further, there are merits in that processing can be performed without heating and that processing can be performed under atmospheric pressure or vacuum of about $10^{-2}$ Torr, and so on. As the vacuum ultraviolet generating device, various types or scales of devices such as a vertical vacuum ultraviolet generating device (MPA-1304-A) and a general purpose vacuum ultraviolet generating device (MPA-2010-A) manufactured by NTP Inc. and an excimer VUV/$O_3$ cleaning device manufactured by USHIO Inc. are manufactured, and a commercially available device can be selected according to the configuration of the decarburizing processing unit.

According to the decarburizing processing unit shown in FIG. 18, decarburizing processing can be performed without heating but with high efficiency, and thus, there is an advantage in that the crystal structure of the raw material powder or the like is hardly affected. Therefore, a structure can be formed by employing high-quality raw material powder in which an amount of impurity has been significantly reduced.

In addition to the above explained first to fourth configuration examples of decarburizing processing unit, decarburizing processing may be performed by combining plural means selected from among means for heating by a heater, means for heating by microwave application, means for applying plasma, means for applying ultraviolet light, and means for applying vacuum ultraviolet light. For example, while the interior of the decarburizing processing unit is heated by a heater, ultraviolet light is applied to an aerosol introduced therein. Thereby, the organic contamination adhering to the surface of the raw material powder or contained in the raw material powder can be disparted with less energy than that when ultraviolet application is singly performed. Further, since the temperature within the processing chamber can be set lower than that when only heating is performed, there is no possibility that the composition of the raw material powder changes due to heat.

Further, although the raw material powder is once dispersed with a gas and decarburizing processing is performed on the aerosolized raw material powder in the embodiment, the decarburizing processing may be performed while the raw material powder is dispersed (aerosolized). For example, when an ultraviolet lamp or the like is provided in the aerosol generation chamber 1 as shown in FIG. 1, those two processings may be simultaneously performed.

According to the first embodiment of the present invention, the raw material powder (aerosol) in which the amount of impurity has been reduced by the decarburizing processing is not exposed to an external atmosphere but supplied directly to the injection nozzle 9 (FIG. 1), and thus, there is no possibility that impurity newly adheres to the raw material powder. Therefore, high-quality structures that can bear the post anneal processing at high temperature can be efficiently manufactured.

Next, a method of manufacturing a composite structure according to the second embodiment of the present invention will be explained.

Here, in the above explained first embodiment of the present invention, decarburizing processing of the raw material powder is performed in the middle of transportation of the aerosol generated in the aerosol generation chamber 1 as shown in FIG. 1 to the film formation chamber 7. However, the processing of generating an aerosol may be performed on the raw material powder that has been decarburizing processed in advance. In this case, at the time of film formation, a typical AD film forming apparatus (e.g., an apparatus formed by omitting the decarburizing processing unit 6 in the film forming apparatus as shown in FIG. 1) is used.

As a method of performing decarburizing processing on the raw material powder, as explained in the first embodiment, the method of heating the raw material powder by using a heater, the method of heating the raw material powder by applying microwave thereto within a heating furnace provided with an isothermal barrier, and the method of performing plasma cleaning, UV cleaning or VUV cleaning by applying plasma, ultraviolet light or vacuum ultraviolet light on the raw material powder can be applied.

Further, it is desirable that, after decarburizing processing, the recontamination of the raw material powder surface is suppressed by purging the air within the processing chamber with nitrogen gas or the like. Furthermore, it is desirable that, subsequently, the raw material powder is stored within a desiccator an atmosphere of which is substituted by nitrogen gas or the like.

Thus, according to the second embodiment of the present invention, a general AD film forming apparatus can be used, and further, generally and commercially available heater, microwave applying device, plasma cleaning device, UV cleaning device, UV lamp, VUV applying device and so on can be used in the decarburizing processing unit. Therefore, high-quality structures that can bear the post anneal processing at a high temperature can be efficiently manufactured at low cost.

Here, in the embodiment, before aerosolizing the raw material powder subjected to the decarburizing processing, it may be ground using a mill or the like. This is because sometimes the raw material powder is agglomerated (necking) during the decarburizing processing. If such agglomerated particles are left, when the agglomerated particles collide with the substrate, the kinetic energy thereof is consumed in the grinding of the particles, and deformation and crushing of particles causing mechanochemical reaction cannot be achieved.

As one example of the method of manufacturing a composite structure according to the embodiment, a PZT film has been fabricated.

First, decarburizing processing is performed on PZT raw material powder of 50 g having a carbon content of about 160 ppm by heating the raw material powder within atmospheric air or an atmosphere containing oxygen ($O_2$) at a temperature about 800° C. for about five minutes within a microwave heating furnace. Thereby, the carbon content in the PZT raw material powder is reduced to about 60 ppm. It is conceivable that the carbon is generated when carbon dioxide within the atmosphere or alkyl compounds adheres to the raw material powder after the decarburizing processing. Furthermore, the raw material powder agglomerated during the decarburizing processing is ground by milling the raw material powder.

Thus fabricated raw material powder is placed in the aerosol generating unit of the film forming apparatus and aerosolized by introducing oxygen ($O_2$) as a carrier gas. Then, film formation is performed by transporting the aerosol to the vacuumed film formation chamber and injecting the aerosol toward an YSZ (yttria-stabilized zirconia) substrate from the nozzle. At this time, the substrate temperature is set to about 500° C. Furthermore, heat treatment is performed on thus fabricated AD film in atmospheric air at a temperature about 1000° C. for about three hours.

In the resulting composite structure, although the PZT film is heat-treated at a high temperature (800° C. or more), the PZT film is not separated from the YSZ substrate and no hillock is generated. Further, from the observation of the PZT film structure, it has been confirmed that the average crystal particle diameter is larger than 400 nm and crystal growth is promoted by the heat treatment at high temperature. Furthermore, the relative density of the PZT film is equal to or more than 90% and very dense. In addition, from the measurement of the electric property of the PZT film, it has been confirmed that a good value is indicated.

Here, the relative density refers to a ratio of a measurement value of the density of the PZT film as an object to be measured to the density of PZT based on documents and theoretical values (theoretical density), and it is expressed by the expression: relative density (%)=(measurement value of density/theoretical density)×100. In the present application, the relative density is used as an index representing denseness, and the higher the relative density, the higher the denseness.

Further, in the embodiment, the density of the PZT film is measured by using an electronic densimeter SD-200L manufactured by ALFA MIRAGE Co., Ltd. according to the Archimedes method. The Archimedes method is also referred to as "underwater mass method" and a method of measuring the masses of an object in air and in water to obtain apparent density by using the following expression.

(apparent density)=(mass in air)/{(mass in air)−(mass in water)}

Here, {(mass in air)−(mass in water)} represents buoyancy and corresponds to the volume of the object.

Next, a method of manufacturing a composite structure according to the third embodiment of the present invention will be explained by referring to FIG. 19. The method of manufacturing a composite structure according to the embodiment is for performing film formation according to the AD method by employing the raw material powder that has been decarburizing processed in advance as in the second embodiment, but characterized in the decarburizing processing method.

Figure 19:
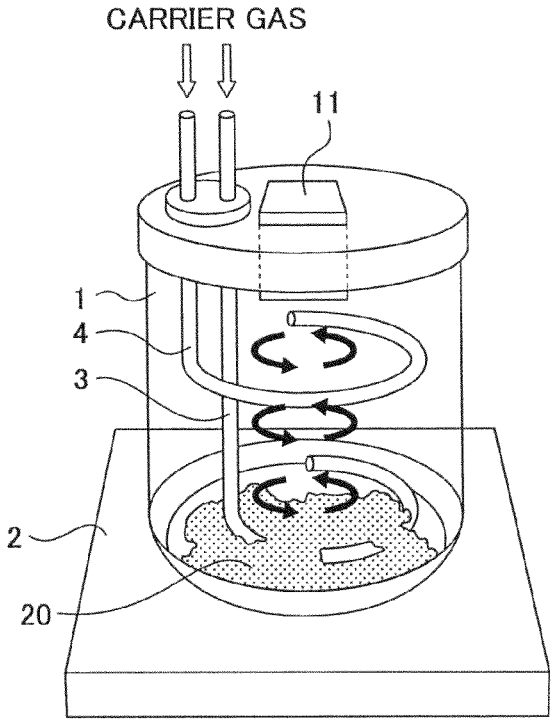
FIG. 19 is a schematic view showing a configuration of a decarburizing processing apparatus to be used in a method of manufacturing a composite structure according to the third embodiment of the present invention.

FIG. 19 is a schematic view showing a configuration of a decarburizing processing apparatus, which corresponds to the impurity removal processing apparatus, to be used in the embodiment. The decarburizing processing apparatus is formed by providing a decarburizing processing unit (processing means) 11 in the aerosol generating unit 1-4 as shown in FIG. 1. That is, in the embodiment, raw material powder is once dispersed in a gas and decarburizing processing is performed on the aerosolized raw material powder. As the decarburizing processing unit 11, a heater, microwave oscillator, plasma generator, ultraviolet lamp or VUV applying device is used as explained in the first embodiment. Further, a combination of the heater and the other device may be used.

When the raw material powder is thus dispersed, heat, UV or the like can be applied evenly to each fine raw material powder, and therefore, impurity can be removed efficiently and reliably. Thereby, the amount of impurity finally left in the raw material powder can be significantly reduced.

The decarburizing processing apparatus as shown in FIG. 19 may be connected to a general AD film forming apparatus and the decarburizing processed raw material powder may be directly introduced into the injection nozzle.

As explained above, according to the first to third embodiments of the present invention, the separation of AD film and generation of hillocks can be suppressed at the time of heat treatment, and therefore, the manufacture yield can be improved and the cost of manufacturing can be reduced. Further, it becomes possible that the AD film is annealed at high temperature (e.g., 800° C. to 900° C., or about 1000° C.), and therefore, the electric property (piezoelectric property) can be improved by the promotion of the crystal grain growth.

Here, in the first to third embodiments, when the raw material powder is heated by a heater or microwave application as the decarburizing processing, the heating is desirably performed in an oxygen atmosphere or atmosphere containing oxygen such as atmospheric air. This is because, in an atmosphere of inactive gas such as helium, carbon or the alkyl compounds adhering to or contained in the raw material powder become difficult to burn at low temperature due to caulking. Accordingly, heating is desirably performed at a temperature of about 600° C. or more in an atmosphere containing no oxygen. On the other hand, decarburization can be efficiently performed at a lower temperature (e.g., about 500° C. to about 600° C.) in an atmosphere containing oxygen. In this respect, in the first embodiment, oxygen is mixed in the carrier gas, and thereby, the decarburizing processing can be performed at lower temperature, or, at the same temperature, the decarburizing processing can be performed efficiently.

Further, when the decarburizing processing is performed by heating in configuration using a heater or microwave under reduced pressure, similarly to the case of using the inactive gas atmosphere, the decarburizing processing is also desirably performed at high temperature. This is because the oxygen concentration is low in the atmosphere.

Furthermore, when oxygen is contained in the composition of the raw material powder, the decarburizing processing is desirably performed in an atmosphere containing oxygen for preventing oxygen loss.

Figure 20:
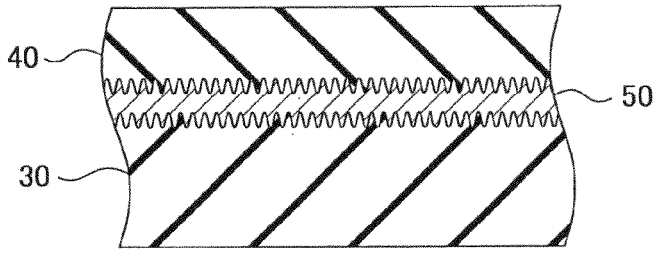
FIG. 20 is a sectional view showing a modified example of a composite structure fabricated by using the film forming apparatus shown in FIG. 1.

In the first to third embodiments, although the AD film is formed directly on the substrate, an intermediate layer may be formed between the substrate and the AD film according to the kind of substrate, the kind of raw material powder, the use of the fabricated AD film and so on. For example, as shown in FIG. 20, an electrode layer 50 may be provided between the substrate 30 and the AD film 40. Alternatively, an adhesion layer for improving adhesion between the substrate and the AD film may be provided between the substrate and the AD film.

In the above explanation, although PZT is used as an inorganic material for forming the AD film, other functional materials such as PLZT (lanthanum doped lead zirconate titanate), $TiBaO_3$ (barium titanate) or $Al_2O_3$ (aluminum oxide) may be used. For example, a PLZT film is applicable to an optical member, and a $TiBaO_3$ film is applicable to a ceramic condenser.

Industrial Applicability

The present invention can be applied to a method of manufacturing a composite structure by using an aerosol deposition method of depositing raw material powder on a substrate by injecting the raw material powder toward the substrate, an impurity removal processing apparatus and a film forming apparatus to be used in the method of manufacturing a composite structure, and so on.

The invention claimed is:

1. A method of manufacturing a composite structure, said method comprising the steps of:

(a) dispersing raw material powder formed of PZT (lead zirconate titanate) with a gas, thereby aerosolizing the raw material powder;

(b) heating the raw material powder to a temperature not lower than 800° C. but lower than a melting point thereof to generate carbon dioxide gas so as to reduce an amount of carbon or compound containing carbon as impurity adhering to or contained in the raw material powder such that an amount of carbon within the raw material powder is not larger than 93 ppm in weight;

(c) spraying the aerosolized raw material powder toward a substrate to cause the raw material powder to collide with an under layer, thereby binding particles having active surfaces newly-formed by deformation and/or crushing of the raw material powder at a time of collision to deposit the raw material powder and form a polycrystalline structure directly or indirectly on said substrate; and (d) annealing the polycrystalline structure formed on said substrate at step (c) at a temperature of at least 1000° C. for at least three hours so as to obtain a PZT film having an averaged crystal particle diameter larger than 400 nm and a light transmission factor of at least 20% with respect to light having a wavelength within a range from 500 nm to 900 nm when said PZT film has a thickness of 300 μm.

2. A method according to claim 1, wherein step (b) includes heating the raw material powder after the raw material powder is aerosolized at step (a).

3. A method according to claim 1, wherein step (a) includes dispersing the raw material powder after the raw material powder is heated at step (b).

4. A method according to claim 1, wherein said compound containing carbon includes an alkyl compound.

5. A method according to claim 4, wherein said alkyl compound includes at least one of $C_{20}H_{42}$, $C_{20}H_{40}$, $C_{22}H_{46}$ and $C_{24}H_{50}$.

6. A method according to claim 1, wherein step (b) includes applying microwave to the raw material powder.

7. A method according to claim 1, wherein step (b) includes heating the raw material powder in an atmosphere containing oxygen.

8. A method according to claim 1, wherein step (b) includes applying at least one of plasma, ultraviolet light and vacuum ultraviolet light to the raw material powder.

9. A method according to claim 1, wherein step (b) includes applying at least one of plasma, ultraviolet light and vacuum ultraviolet light to the raw material powder while heating the raw material powder.

10. A method of manufacturing a composite structure, said method comprising the steps of:

(a) heating raw material powder formed of PZT (lead zirconate titanate) to a temperature not lower than 800° C. but lower than a melting point thereof to generate carbon dioxide gas so as to reduce an amount of carbon or compound containing carbon as impurity adhering to or contained in the raw material powder such that an amount of carbon within the raw material powder is not larger than 93 ppm in weight;

(b) grounding the raw material powder heated at step (a);

(c) dispersing the raw material powder grounded at step (b) with a gas, thereby aerosolizing the raw material powder;

(d) spraying the aerosolized raw material powder toward a substrate to cause the raw material powder to collide with an under layer, thereby binding particles having active surfaces newly-formed by deformation and/or crushing of the raw material powder at a time of collision to deposit the raw material powder and form a polycrystalline structure directly or indirectly on said substrate; and (e) annealing the polycrystalline structure formed on said substrate at step (d) at a temperature of at least 1000° C. for at least three hours so as to obtain a PZT film having an averaged crystal particle diameter larger than 400 nm and a light transmission factor of at least 20% with respect to light having a wavelength within a range from 500 nm to 900 nm when said PZT film has a thickness of 300μm.

11. A method of manufacturing a composite structure, said method comprising the steps of:

(a) dispersing raw material powder formed of PZT (lead zirconate titanate) with a gas, thereby aerosolizing the raw material powder;

(b) heating the raw material powder aerosolized at step (a) to a temperature not lower than 800° C. but lower than a melting point thereof to generate carbon dioxide gas so as to reduce an amount of carbon or compound containing carbon as impurity adhering to or contained in the raw material powder such that an amount of carbon within the raw material powder is not larger than 93 ppm in weight;

(c) dispersing the raw material powder heated at step (b) with a gas, thereby aerosolizing the raw material powder;

(d) spraying the raw material powder aerosolized at step (c) toward a substrate to cause the raw material powder to collide with an under layer, thereby binding particles having active surfaces newly-formed by deformation and/or crushing of the raw material powder at a time of collision to deposit the raw material powder and form a polycrystalline structure directly or indirectly on said substrate; and (e) annealing the polycrystalline structure formed on said substrate at step (d) at a temperature of at least 1000° C. for at least three hours so as to obtain a PZT film having an averaged crystal particle diameter larger than 400 nm and a light transmission factor of at least 20% with respect to light having a wavelength within a range from 500 nm to 900 nm when said PZT film has a thickness of 300μm.

* * * * *